US010941967B2

(12) United States Patent
De Larminat et al.

(10) Patent No.: US 10,941,967 B2
(45) Date of Patent: Mar. 9, 2021

(54) LUBRICATION AND COOLING SYSTEM

(71) Applicant: Johnson Controls Technology Company, Auburn Hills, MI (US)

(72) Inventors: Paul Marie De Larminat, Nantes (FR); Damien Jean Daniel Arnou, La Seguiniere (FR)

(73) Assignee: Johnson Controls Technology Company, Auburn Hills, MI (US)

( * ) Notice: Subject to any disclaimer, the term of this patent is extended or adjusted under 35 U.S.C. 154(b) by 107 days.

(21) Appl. No.: 16/263,676

(22) Filed: Jan. 31, 2019

(65) Prior Publication Data

US 2019/0162457 A1 May 30, 2019

Related U.S. Application Data

(62) Division of application No. 14/768,489, filed as application No. PCT/US2014/017115 on Feb. 19, 2014, now Pat. No. 10,197,316.

(Continued)

(51) Int. Cl.
*F25B 43/02* (2006.01)
*F04D 17/12* (2006.01)

(Continued)

(52) U.S. Cl.
CPC ..... *F25B 43/02* (2013.01); *F01K 25/08* (2013.01); *F04D 17/12* (2013.01); *F04D 25/06* (2013.01);

(Continued)

(58) Field of Classification Search
CPC ..... F25B 43/02; F25B 31/004; F25B 31/008; F25B 1/053; F25B 2500/16; F25B 11/00;

(Continued)

(56) References Cited

U.S. PATENT DOCUMENTS 2,986,905 A * 6/1961 Grant ..... F25B 1/10 62/475
3,358,466 A 12/1967 Weller et al.
3,620,038 A 11/1971 Muench
3,866,438 A 2/1975 Endress (Continued)

FOREIGN PATENT DOCUMENTS

CN 101180507 A 5/2008
EP 1072853 A1 1/2001

(Continued)

*Primary Examiner* — Emmanuel E Duke
(74) *Attorney, Agent, or Firm* — Fletcher Yoder, P.C.

(57) ABSTRACT

A system for reducing the refrigerant pressure in an oil sump or in a cavity of a housing. The invention is particularly useful for reducing pressure in a compressor for heat pump applications that has been validated for water chiller operations or in turbine and generator systems in ORC systems generating electricity using refrigerant, the ORC systems essentially being a heat pump application operating in reverse. An auxiliary compressor, an auxiliary condenser or an ejector pump may be used to reduce pressure in the oil sump, to separate refrigerant from oil. The auxiliary compressor, the auxiliary condenser or the ejector pump may also be used to reduce the pressure of refrigerant in the housing of a compressor in heat pump applications at temperatures and pressures at which the compressor was validated for water chiller applications and of the turbine and generator in ORC applications.

6 Claims, 14 Drawing Sheets

Related U.S. Application Data

(60) Provisional application No. 61/767,402, filed on Feb. 21, 2013.

(51) Int. Cl.

| | |
|---|---|
| ***F04D 29/063*** | (2006.01) |
| ***F04D 29/58*** | (2006.01) |
| ***F04D 25/06*** | (2006.01) |
| ***F25B 31/00*** | (2006.01) |
| ***F01K 25/08*** | (2006.01) |
| *F25B 1/053* | (2006.01) |

(52) U.S. Cl.
CPC ..... *F04D 29/063* (2013.01); *F04D 29/5806* (2013.01); *F25B 31/004* (2013.01); *F25B 31/008* (2013.01); *F25B 1/053* (2013.01); *F25B 2500/16* (2013.01)

(58) Field of Classification Search
CPC ..... F25B 39/04; F25B 41/04; F25B 2600/05; F25B 30/00; F25B 30/02; F04D 25/06; F04D 17/12; F04D 29/063; F04D 29/5806; F01K 25/08
See application file for complete search history.

(56) References Cited

U.S. PATENT DOCUMENTS

| | | | | |
|---|---|---|---|---|
| 4,404,811 | A | 9/1983 | Mount et al. | |
| 4,662,190 | A | 5/1987 | Tischer | |
| 5,174,740 | A | 12/1992 | Jang | |
| 7,181,928 | B2 * | 2/2007 | de Larminat | F04D 29/584 62/505 |
| 8,434,323 | B2 * | 5/2013 | Welch | F25B 31/006 62/505 |
| 2008/0210601 | A1 * | 9/2008 | Shoulders | F25B 43/02 208/184 |
| 2010/0006262 | A1 | 1/2010 | Welch et al. | |
| 2011/0056379 | A1 | 3/2011 | Lucas | |
| 2013/0156544 | A1 * | 6/2013 | Sishtla | F04D 29/058 415/1 |

FOREIGN PATENT DOCUMENTS

| | | | | |
|---|---|---|---|---|
| EP | 1087190 | A1 | 3/2001 | |
| JP | S52-036242 | A | 3/1977 | |
| JP | S55164481 | U | 11/1980 | |
| JP | 2000-74506 | A | 3/2000 | |
| JP | 2007218507 | A | 8/2007 | |
| JP | 5236242 | B2 | 7/2013 | |
| WO | 2007008193 | A2 | 1/2007 | |
| WO | WO-2012082592 | A1 * | 6/2012 | F04D 25/0606 |

* cited by examiner

LUBRICATION AND COOLING SYSTEM

CROSS-REFERENCE TO RELATED APPLICATION

This application is a divisional of U.S. patent application Ser. No. 14/768,489, entitled "LUBRICATION AND COOLING SYSTEM," filed Aug. 18, 2015, which is a national stage entry of International Application No. PCT/US2014/017115, entitled "LUBRICATION AND COOLING SYSTEM," filed Feb. 19, 2014, which claims priority to U.S. Provisional Patent Application No. 61/767,402, filed Feb. 21, 2013.

FIELD OF THE INVENTION

This invention is generally directed to reducing the amount of miscible refrigerant in lubricant in lubrication systems used in refrigeration systems heat pumps and organic Rankine cycle (ORC) systems, and specifically to reducing the amount of refrigerant in lubricating oil, or alternatively, to reduce the refrigerant pressure in the housing of a semi-hermetic or hermetic motor or generator used in a refrigerant circuit so as to improve the cooling of the motor or generator.

BACKGROUND OF THE INVENTION

Centrifugal compressors are routinely used for medium to large capacity water chillers used for air conditioning or process applications, with a chilled water temperature leaving the chiller to the space to be cooled typically of the order of about 7° C. (45° F.). In order to generate energy savings and benefit from renewable energies, there is a growing demand for heat pumps. In some applications, the "cold source" of such heat pumps can be at a relatively high temperature fluid, for instance, when the heat pump is used to boost the temperature of geothermal water. Due to the great variety of possible applications, the leaving chilled water temperature from the evaporator of heat pumps can vary over a very wide range, typically from 5 to 60° C. (41-140° F.). In the lower side of this temperature range, conditions at the evaporator are similar to those of a standard water chiller; therefore, the design of a heat pump for such applications is very close to that of a standard water chiller. But as the temperatures of the leaving chilled water temperature at the evaporator rises, the leaving chilled water temperature eventually reaches a point where the standard water chiller technology can no longer be used.

Compressors are a key component in HVAC systems, and compressor operating conditions are defined by the evaporating and condensing pressures and temperatures. Some compressors are so-called hermetic and semi-hermetic compressors. These compressor units have the motor sealed inside a common housing with the compressor. The motor operates in an atmosphere of refrigerant, the refrigerant surrounding and cooling the motor. The only major difference between a semi-hermetic compressor and a hermetic compressor is that the housing for a semi-hermetic compressor comprises flanges that can be disassembled to service the compressor or motor. Hermetic compressors are usually of smaller size, like those of household refrigerators or window air conditioning. They are completely canned in a sealed enclosure and cannot be disassembled. Compressors that are neither semi-hermetic nor hermetic are driven by motors that are outside of the refrigerant circuit and which are cooled by non-refrigerant fluid, such as air or water. These compressors are referred to as open compressors. This invention finds particular applicability to semi-hermetic compressors and hermetic compressors, although it may find use in open compressors. The terms semi-hermetic, hermetic, semi-hermetic compressors and hermetic compressors may be used interchangeably herein.

The difference between evaporating and condensing temperatures associated with evaporating and condensing pressures is typically of the order of delta (Δ) 50° C. ((Δ) 90° F.). In the upper range of temperatures for heat pumps, the evaporation temperature can be as high as 60° C. (140° F.) or even higher. Taking into account a normal pinch on the evaporator, the evaporation temperature is typically about (Δ) 2° C. ((Δ) 3.6° F.) lower than the leaving water temperature from the evaporator, resulting in a leaving water temperature of about 62° C. (144° F.) when the evaporation temperature is 60° C.

Water chillers and heat pumps using centrifugal compressors normally use synthetic refrigerant fluids derived from hydrocarbons. Because of environmental concerns, several families of synthetic refrigerants have been used, are being used, or are under development, belonging to the families of CFC's, HCFC's, HFC's or HFO's. Most centrifugal chillers in operation today are using HFC-134a. For the higher temperature range of heat pump applications, the tendency is to use lower pressure refrigerant fluids like HFC-245fa. These HFC's are likely to be replaced to a certain extent by future generation hydrofluoro-olefins (HFO's).

In the lubrication circuit of a typical centrifugal compressor, oil is collected from the lower part of the oil sump. It is circulated by an oil pump and pressurized to send it to the bearings and to the other points in the compressor requiring lubrication, for example, the gears for a gear-driven compressor, and also the shaft seal. After providing lubrication, the oil is drained and returned to the oil sump by gravity. The system is complemented by an oil cooler, usually located at the pump discharge before injection of lubricant into the compressor. The oil cooler has the effect of eliminating heat generated by mechanical friction generated in the compressor, for instance in the bearings and in the gears that is absorbed by the lubricant. An oil heater is also installed in the oil sump to keep the oil sufficiently warm when the compressor is not operating, so as to provide a lubricant of suitable viscosity to properly lubricate the compressor on start-up.

In lubricated compressors used in refrigerant circuits, the lubricating oil, a liquid, is in the presence of a gas refrigerant in the oil sump and various parts of the lubrication oil circuit. In centrifugal or reciprocating compressors, the pressure in the oil sump is usually equalized or vented at or close to the suction pressure of the compressor. This function is performed by a gas-equalizing line collecting gas refrigerant from the upper part of the oil sump. The collected gas refrigerant is returned to the low pressure side of the refrigerant circuit, such as the evaporator or compressor suction. The reason for this venting is related to the mutual miscibility between lubricating oils and most of the refrigerants, and to the effect of this miscibility on the oil viscosity. The viscosity of a blend of oil and refrigerant depends not only on the temperature, but also on the dilution of refrigerant in the oil. This dilution depends on the temperature of the refrigerant and oil and the pressure of the refrigerant gas. The general tendency is that the amount of refrigerant in solution in the oil increases as the temperature decreases, while increasing the dilution by the refrigerant tends to reduce the viscosity. Due to this mechanism, lowering the temperature of the refrigerant and oil tends to reduce the oil viscosity; this is opposed to the normal tendency for pure oil, where the viscosity decreases as the temperature increases. Therefore, the refrigerant in solution in the oil and the resulting viscosity are in a complex relationship, depending on the fluid temperature, the refrigerant pressure, and the mutual miscibility of the oil and refrigerant. Besides having the effect of reducing the oil viscosity, the dilution by refrigerant in the oil can have other adverse effects. The main one is oil foaming in some parts of the circuit in case of pressure reduction or temperature increase. This can result in undesirable cavitation of oil pumps, or drastically reduced lubricity, potentially resulting in mechanical failures.

The refrigerant in the lubrication circuit comes from two sources. The first source of refrigerant gas is in the circulating oil itself. The path of the oil within the compressor for lubrication purposes places the oil in contact with refrigerant. Some refrigerant can enter into the oil lubrication circuit in both a gas phase and a liquid phase. As the oil is in the presence of gas refrigerant in many parts of the refrigeration circuit, the oil tends to absorb some refrigerant. Gas refrigerant from locations of higher pressure in the compressor also migrates to the sump, which is at a lower pressure. A typical example is the gas leakage from and around the labyrinth seals. Likewise, in a reciprocating compressor, some of the compressed refrigerant gas will leak through the piston rings and migrate into the sump. In addition, the lubrication process may induce some high agitation of the oil resulting in oil foaming. Examples include lubrication of high speed gears or oil splashing resulting from the crankcase rotation in a reciprocating compressor. It should be noted that the oil return circuit also may introduce a substantial amount of liquid refrigerant into the sump, and not all of the liquid refrigerant entering the sump flashes off immediately. Due to this complex mechanism, some refrigerant must be permanently removed from the compressor oil sump. One purpose of the oil sump is to provide the oil an opportunity to settle and release refrigerant gas bubbles before being re-circulated in the lube oil circuit. Even after this gas separation, some refrigerant remains dissolved in the oil that resides in the sump. The vapor space above the oil in the sump is usually vented directly to the compressor suction, which is at pressure only slightly lower than that of the evaporator. The slightly higher pressure in the sump forces the gas refrigerant that is separated to be reintroduced into the compressor at its suction point as a vapor. In the case of a centrifugal compressor, the total amount of refrigerant that needs to be removed from the sump is typically of the order of 1 to 3% of the total flow of the compressor.

In heat pump applications, the evaporation pressure tends to be substantially higher than in water chillers, which increases the amount of refrigerant absorbed by the oil, tending to decrease the oil viscosity and reduce its lubricity. The oil temperature also should be set to a higher value in order to keep the oil dilution level at an acceptable value, further reducing the oil viscosity. To compensate for this effect, an oil grade with higher viscosity can be used. But even with this compensation for the viscosity, the temperature elevation raises other issues. Among these is a risk of failure of the shaft seals and bearings when the oil temperature is too high. There is no fundamental reason why this issue could not be resolved to a certain extent, but it may require time consuming and expensive validations leading to out-of standard and more expensive solutions. Therefore, what is desired is a system that would compensate for some of the differences between standard chillers and higher temperature heat pump conditions. This would also allow extending the range of application of standard air conditioning compressors beyond chiller applications to heat pump applications.

To keep costs low for heat pumps used in systems such as geothermal systems, and to minimize complications for technicians and other service personnel, it is desired to maintain equipment design and commonality for chillers used as high temperature heat pumps as close as possible to those used for standard water chilling systems. However, systems utilizing a substantially higher evaporation temperature, such as used in heat pump applications, raise a number of questions, especially related to the lubrication system and motor cooling, as well as to the lubrication of the shaft seal in designs employing an open compressor. What is needed is a system that can reduce the amount of refrigerant absorbed by the oil so the lubricity of the oil is not adversely affected.

BRIEF DESCRIPTION OF THE INVENTION

The present invention solves the problem of refrigerant absorption or refrigerant solubility in oil in compressors operating at elevated temperatures. The refrigerant system includes a compressor, a condenser, and an evaporator. The compressor compresses low pressure refrigerant gas to a higher pressure refrigerant gas. The high pressure refrigerant gas is condensed into a high pressure liquid. An expansion valve between the condenser and the evaporator reduces the pressure of the high pressure liquid and may produce a low pressure mixture of gas and liquid which is then sent to the evaporator. The evaporator changes the state of the liquid to a gas while providing cooling, and the low pressure gas is resent back to the compressor. The system also includes a sump that collects oil used to lubricate the compressor. The sump is usually located below the compressor or at a low point of the compressor to gather oil from compressor lubrication by gravity. While this system as described above is well known, the present invention further includes a pressure reducing device positioned between the oil sump and a low pressure side of the refrigerant system. This device lowers the pressure of the refrigerant gas in the oil sump to a pressure substantially lower than the gas pressure at the compressor suction.

Lowering the pressure of refrigerant in the oil sump has the effect of reducing the dilution of refrigerant in the oil, which has several beneficial effects. The reduced miscibility of refrigerant in the oil mitigates the reduction of oil viscosity due to temperature/pressure, resulting in higher oil viscosity. As the reduction of the dilution in the prior art is achieved by increasing the temperature of the oil, thereby resulting in expulsion of refrigerant from the oil, but undesirably raising the temperature of the oil and reducing its lubricity. Achieving reduction of dilution by lowering the pressure of refrigerant in the sump also has the effect of reducing the need to increase this oil temperature. This lower oil temperature also results in a better control of the viscosity of the oil and better lubricity. Better lubricity also reduces the risk of deterioration on certain components of the compressor, like shaft seals and bearings, while also reducing the likelihood of breakdown of the oil and extended oil life.

The invention also provides a method for cooling a motor of a semi-hermetic compressor in a vapor compression system used in high temperature heat pumps. The invention may be used irrespective of the technology used for the motor bearings. These bearings may require lubrication or may be oil free, such as oil-free ball bearings or systems that utilize electromagnetic bearings. In a semi-hermetic compressor, refrigerant is used to cool the motor and bearings in the form of gas or liquid and usually at temperature and pressure close to the conditions at the compressor suction. In a conventional system, the pressure and associated saturated temperature at which the refrigerant is sent into the motor cannot be lower than the evaporating pressure in the refrigerant circuit. This is satisfactory for systems operating at normal air conditioning temperatures; but there are limits to the system when operating at higher evaporation temperatures, like in high temperature heat pumps. Under these conditions, it is desired to reduce the pressure in the motor housing in the same way as it is desired to reduce the pressure in the oil sump of a lubricated machine. In this invention, a pressure reducing device, which may be a mechanical device, is positioned between the motor and the low pressure side of the refrigerant system. The pressure reducing device is used to lower the pressure of the refrigerant used to cool the motor and bearings. The device lowers the pressure of the refrigerant cooling the motor, the pressure being substantially lower than the gas pressure at the compressor inlet. The device can be the same as used to lower the pressure in the oil sump of a lubricated compressor.

The use of a device to lower the refrigerant pressure in the motor housing as refrigerant traverses the motor has the beneficial effect of keeping the refrigerant fluid used to cool the motor at a low temperature, even if the evaporation temperature and pressure in the evaporator increase due to the higher heat pump temperatures. Reduced pressure in the motor also may provide a reduction of the gas friction power generated by the speed of the rotating parts, which in turn results in lower friction losses, further helping to reduce motor heating and contribute to motor cooling. In addition to cooling the motor, the refrigerant can be beneficially used to cool bearings that also are located in the motor housing. These bearings can be electromagnetic bearings that require no lubrication but which generate heat, or mechanical bearings that usually require lubrication, but also may be oil-free but generate mechanical heat.

Not only can the equipment set forth in this invention be extended from chiller applications to heat pump applications as higher temperatures are experienced, the invention can also be applied to turbine and generator drive lines in Organic Rankine Cycle (ORC) applications. The ability of this invention to provide motor cooling even as higher temperatures are experienced for heat pump applications extends the use for heat pump applications of equipment currently utilized for chiller applications. This invention can also be used to provide cooling to a generator used in an Organic Rankine Cycle application utilizing a semi-hermetic turbine/generator. In ORC applications, the ORC turbine system operates in substantially the same way as the compressor in a refrigeration system, except in reverse. The ORC turbine system converts mechanical power into electricity, while in the refrigeration or heat pump system, electrical power is utilized to generate mechanical power to drive a compressor. The ORC turbine operates in reverse to the previously described heat pump systems and utilizes the equivalent of a compressor in a heat pump or refrigerant application. The organic fluids are typically the same family of fluids as used in heat pump applications, which includes refrigerants such as HFC-245fa. The heat source is waste heat provided at relatively low temperatures, typically in the range of 90-250° C. (194-482° F.).

Referring now to FIG. 16, since the ORC system runs in reverse to a heat pump system, one skilled in the art would also recognize that the evaporator 27-ORC, referred to as a boiler in the ORC cycle, boils an organic liquid (refrigerant) at high pressure to convert it to a high pressure vapor. A turbine 23-ORC expands the high pressure organic vapor to a low pressure vapor while driving an electrical generator. The electrical generator may be an external device. Alternatively, as depicted in FIG. 16, a motor may run reversibly as a generator, as may be the case with permanent magnet motors utilized in such devices. The turbine/compressor motor may be of a semi-hermetic design or the turbine may be lubricated. The organic vapor, at a lower pressure after passing through the turbine 23-ORC, undergoes a change of state in the condenser 25-ORC, being converted to a low pressure liquid, using a heat transfer mechanism relying on a cold source such as ambient air, or an available water source (river, lake, ocean, aquifer, cooling tower). The low pressure organic liquid is then compressed and returned to the evaporator or boiler by a liquid pump 31-ORC as a high pressure organic liquid. As is evident, in the ORC system, high pressure and low pressure sides of the circuit are reversed from that in the heat pump or refrigerant system, the high pressure being on the evaporator side rather than on the condenser side in the heat pump or refrigeration system, and the low pressure side is on the condenser side rather than on the evaporator side in the heat pump or refrigeration system. On the liquid side, the ORC system utilizes a liquid pump 31-ORC to raise the pressure of the low pressure liquid and return it to the evaporator instead of the expansion valve 31 used to reduce the pressure of the high pressure liquid in the heat pump or refrigeration system.

Similar to "open" compressor systems for heat pumps, where an external motor is driving a separate lubricated compressor, turbines for ORC systems are often separate from the generator, as represented in FIG. 16. The problems encountered lubricating a compressor in a high temperature heat pump system are very similar to those with an ORC turbine, due to the equivalent temperature, fluid and oil miscibility properties in the two systems. The problems being the same, the present invention also is operable in an ORC system to achieve substantially the same results, since the organic fluid (refrigerant) is still miscible in oil, which is used to lubricate the compressor-equivalent (turbine) and the mixture of oil and refrigerant is sent to a sump 10. In state-of-the-art systems, the sump 10, typically positioned below the lubricated turbine 23-ORC, is at substantially the same pressure as the compressor equivalent (turbine). In accordance with the present invention, the sump 10 is set at a lower pressure that the turbine. This pressure difference separates the organic fluid/refrigerant from the lubricant, the lubricant having reduced refrigerant being recycled for lubrication duty, and transfers the organic fluid/refrigerant after separation, to a low pressure point in the system, here between the turbine exhaust and condenser 25-ORC on the condenser side rather than the evaporator side in the heat pump/refrigerant system, where the refrigerant can be condensed or between the turbine exhaust and pump 31-ORC if the refrigerant is in a liquid state at low pressure.

Just as a heat pump may employ a semi-hermetic motor, an ORC driveline can also be semi-hermitic, using motor technology that can run reversibly as a generator, as may be the case with permanent magnet motors utilized in such devices. Then, the pressure reducing devices utilized for motor cooling to extend the motor cooling capability of the refrigerant for heat pump applications may also be utilized for generator cooling in ORC systems in the same manner. That is, refrigerant is utilized to cool the motor and the motor cavity from heat generated by operation of the motor. Pressure reducing devices or throttling devices, such as used in heat pump applications, shown in FIGS. 10-15 are controlled to maintain the pressure of the refrigerant supplied to the generator cavity at a preset value, preferably lower than that of a low pressure side of the system, and to provide the refrigerant to the cavity as a two phase fluid. The source of the refrigerant provided to the throttling device may be either low pressure liquid or high pressure liquid. With ORC systems, the condenser is on the low pressure side of the system, so that refrigerant gas can be drawn through the housing to a low pressure region of the system.

Just as in a system operating in heat pump applications, for an ORC system, it is desired to maintain the pressure in the generator cavity at a preset value below the pressure at the turbine inlet, for example, at a saturation temperature of 20° C. corresponding to the desired pressure for a given refrigerant. FIG. 16 is a schematic of a prior art ORC system, the expander/turbine being the equivalent of a compressor in a heat pump application. The ORC system is different from the familiar turbine systems utilized in many power plants, as those systems are not closed, as described above, utilizing water without refrigerant and operating at significantly higher temperatures. The ORC systems utilize more compact machines than the machines used in water/water vapor generator applications.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
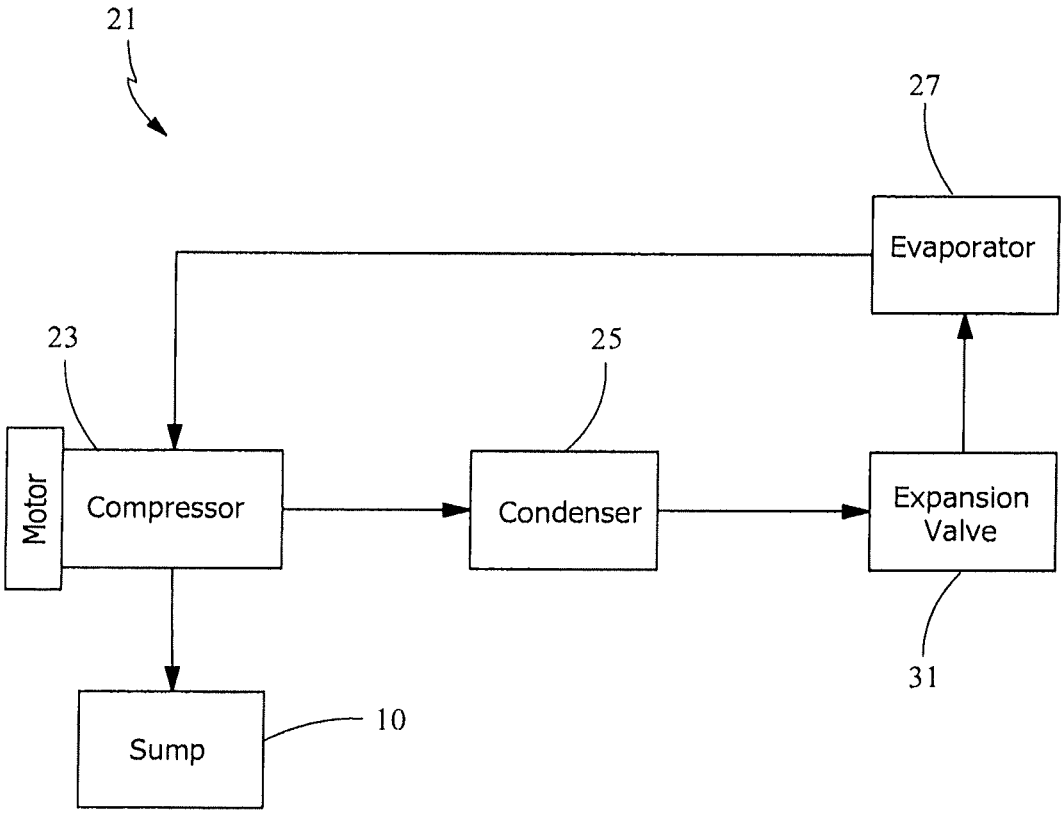
FIG. 1 Prior Art
FIG. 1 is a schematic of a typical well-known refrigeration system, but specifically depicting the oil sump.

FIG. 1 is a schematic of a typical refrigeration system depicting a motor/compressor 23 in fluid communication with a condenser 25 which is in fluid communication with an evaporator 27. Refrigerant gas is compressed to a higher pressure in compressor 23. The high pressure refrigerant gas, after flowing to condenser 25 is condensed to a high pressure liquid via heat exchange, not shown. The high pressure refrigerant liquid is then sent to evaporator 27. An expansion valve 31 intermediate condenser 25 and evaporator 27 expands the high pressure refrigerant liquid to a mist, the mist being a mixture of gas and liquid at a lower temperature. In evaporator 27, the liquid refrigerant is evaporated, absorbing heat from a heat exchange fluid, as liquid refrigerant mist changes phase from liquid to gas. The cooled heat exchange fluid may be sent directly to a building environment or indirectly to an intermediate medium, such as a chiller for storage of chilled water until required. Refrigerant gas from evaporator 27, having undergone a phase change, is at a low pressure and serves as a refrigerant gas source for compressor 23. Also depicted in FIG. 1 is a sump 10, which collects the oil from operation of compressor 23 and is fundamental to proper functioning of compressor 23. Sump 10, as shown, is below compressor so that lubricating oil flows to sump 10 by gravity.

Figure 2:
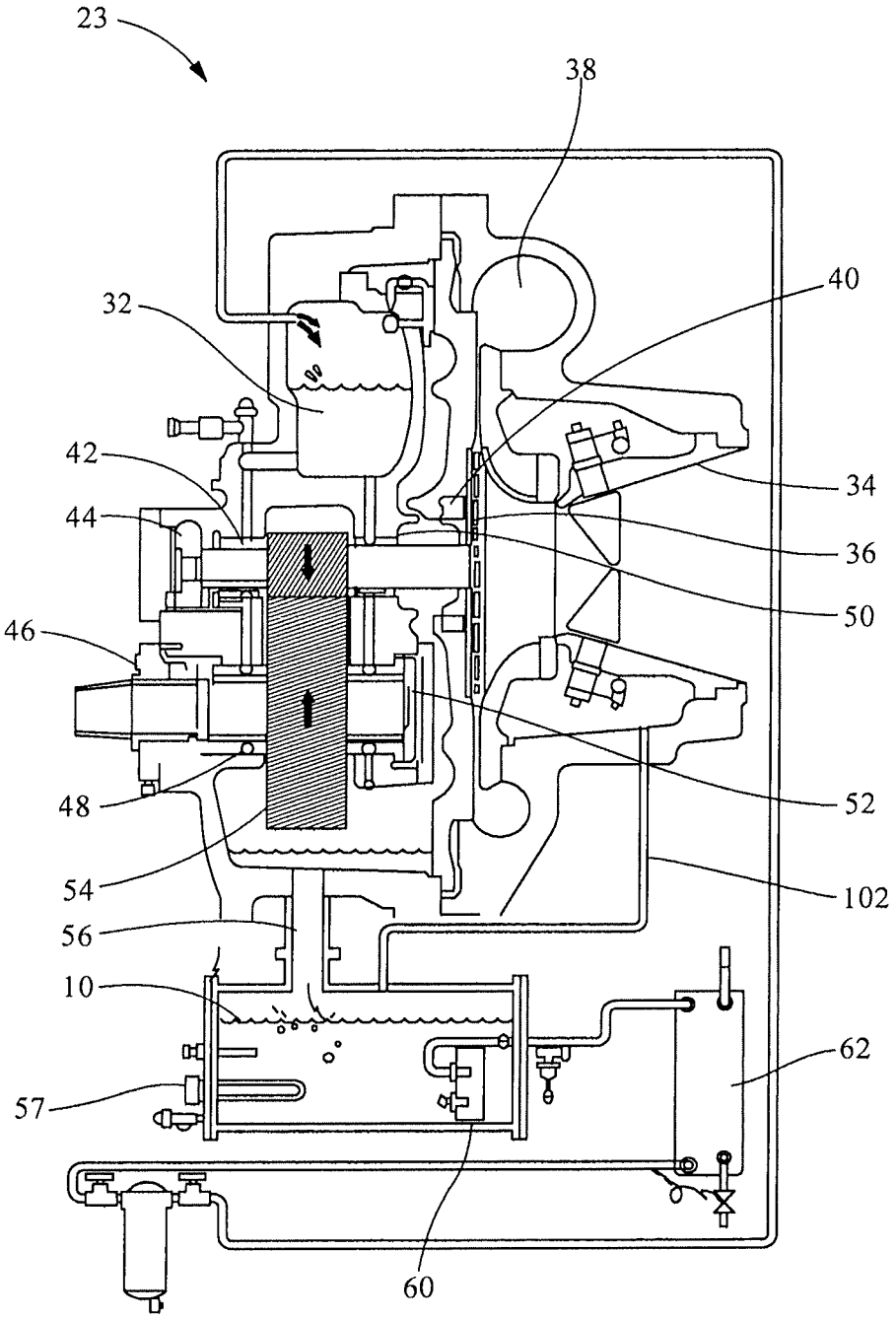
FIG. 2 Prior Art
FIG. 2 is a cross-sectional view of a prior art compressor depicting the associated sump system.

FIG. 2 is a cross-sectional view of a prior art centrifugal compressor and associated sump system. FIG. 2 depicts compressor 23 and oil sump 10. Some lubricating oil is retained in an auxiliary oil reserve 32, intended to keep some oil supply during coast-down in the event of a power failure. Compressor 23 includes an inlet 34 which receives refrigerant gas from a low pressure source, typically an evaporator (shown in FIG. 1). The refrigerant gas is compressed by an impeller 36 before being delivered to volute 38. Lubrication is provided to lubricate shaft seal 40, main journal and thrust bearing 42, thrust collar 44, double bellows shaft seal 46, low speed gear rear bearing 48, pinion gear shaft bearing 50, thrust collar bearing 52 and low speed gear 54. Lubricant and refrigerant are in contact with one another as a small amount of pressurized refrigerant gas invariably leaks from impeller 36 into the various lubricated components described above. After lubricating the compressor components, the lubricant/refrigerant mixture drains by gravity through conduit 56 into sump 10. While settling in oil sump 10 before being re-circulated, refrigerant gas is released from the mixture in excess of the steady-state solubility, dependent upon the pressure and temperature conditions in the sump. Although the exact amount of refrigerant that may collect in sump 10 at any one instant of time is difficult to measure, it is estimated that the refrigerant that is absorbed by the oil and which should be separated in sump 10 is about 1-3% of the total flow of the compressor. To avoid an undesired oil viscosity as the oil cools once the compressor is stopped, an oil heater 57 is provided, heating or maintaining the lubricant within a predetermined temperature range so that it has the proper viscosity as soon as compressor 23 starts. Fluid is pumped from sump 10 by submersible pump 60 and sent to oil cooler 62, which is activated only when the oil is above its predetermined operating temperature. The refrigerant gas that is separated from the oil in the sump is sent to compressor inlet 34 through a vent line 102 (see FIG. 3), while oil, which still may include miscible refrigerant gas, is sent to oil reserve 32 wherein it is metered to the compressor for lubrication purposes, after which the lubrication cycle repeats.

In heat pump systems in which the evaporation pressure and temperature tend to be substantially higher than in water chillers, the oil temperature also should to be set to a higher value in order to keep the oil dilution at an acceptable value. As a result of this higher temperature, the oil viscosity will be reduced if the same grade oil is used as in water chiller systems. An oil grade with higher viscosity can be used to compensate for the higher temperatures experienced in heat pump systems. But even with this compensation for the viscosity, the temperature elevation of the oil in such heat pump systems raises other issues. Among these is a risk of failure of the shaft seals and bearings if the oil temperature should become too high. The present invention provides a system that compensates for some of the differences between operation of standard chillers and higher temperature heat pumps due to the temperature difference of operation that also affects oil temperature. This invention should extend the range of application of current standard compressor systems used in chiller applications to heat pump applications, with minor, inexpensive modifications.

Figure 3:
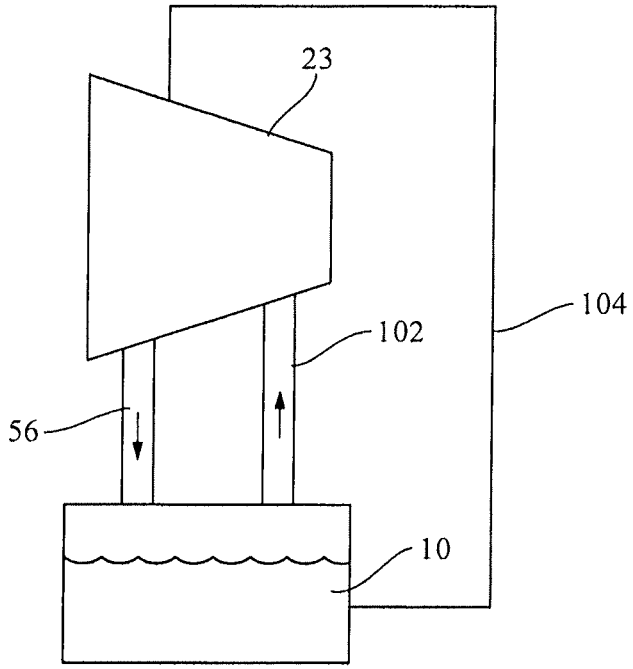
FIG. 3 Prior Art
FIG. 3 is a simplified schematic of a prior art compressor lubrication circuit.

FIG. 3 is a simplified version of the cross sectional representation of prior art FIG. 2 which shows a simplified lubrication cycle schematic (for illustration purposes), with lubricant and miscible refrigerant being drained from compressor 23 through conduit 56 to sump 10, and then refrigerant gas at sump pressure returned to the compressor inlet along gas conduit 102, while lubricant with miscible refrigerant is returned to compressor 23 along conduit 104.

Although FIGS. 3 through 7 are simplified schematics (for illustration purposes) that depict the prior art and the improvement provided by the present invention, the features required for operation of lubrication circuit depicted in FIG. 2 are also present in the circuits represented in FIGS. 4-7, although with the addition of the innovative pressure reducing device 409, as set forth herein.

Figure 4:
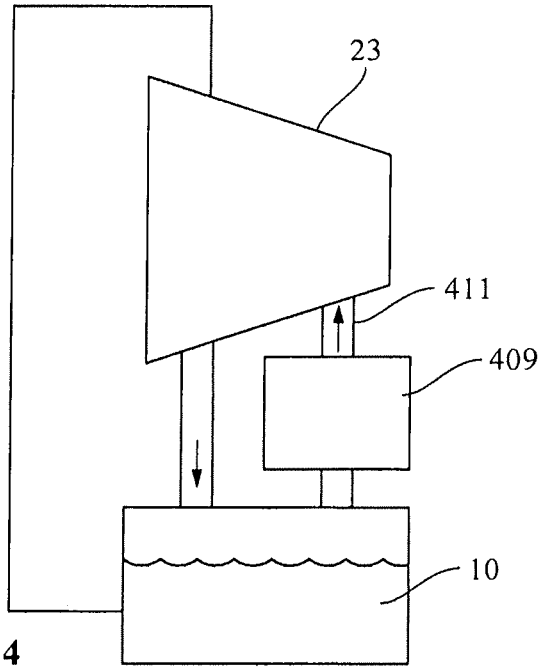
FIG. 4 is a simplified schematic of the compressor lubrication circuit of the present invention.

FIG. 4 provides a simplified version of the present invention, again using a simplified schematic. In FIG. 4, a pressure reducing device 409 is positioned between sump 10 and compressor inlet 34 to draw refrigerant gas from the sump while reducing the pressure of refrigerant gas in the sump. Although pressure reducing device 409 is shown as connected to the inlet of compressor 34 through connection 411, it is not so restricted, and, as will be recognized by one of skill in the art, pressure reducing device 409 can be connected to any low pressure point of the refrigeration circuit. Most often this low pressure point is the evaporator 27, but may be by any connection to the system between the evaporator 27 or an evaporator inlet and compressor inlet 34, including compressor inlet 34. Pressure reducing device 409 enables lowering of the pressure (and temperature) of the refrigerant gas in the oil sump. As previously set forth, the lowering of the pressure of refrigerant gas in oil sump 10 has the beneficial effect of reducing the dilution of refrigerant in the oil, thereby mitigating the reduction of oil viscosity while providing proper lubrication of shaft seals and bearings. Lowering the refrigerant pressure in the oil sump initiates a "virtuous cycle" combining several combined benefits, one of which is the ability of refrigeration system 21 to operate at higher evaporation temperatures and pressures such as encountered in heat pump conditions. When operating at such heat pump conditions, the target for pressure reduction is to set the oil sump gas pressure at a value consistent with the validated range of the same compressor when operating as a water chiller. Thus, if a given type of compressor is validated, for example, for an evaporation temperature of 20° C. (68° F.) with a given refrigerant, the target will be to set the sump pressure corresponding to a 20° C. saturation temperature in heat pump operation, in order to set all the lubrication parameters at the same standard value as for chillers. Of course, this is not enough to guarantee that the machine will be reliable. While this course of action will not solve all of the problems in converting a standard compressor for chiller applications for use in high temperature heat pump applications, as other parameters such as design pressure, shaft power, bearing loads etc. must be validated, problems associated with lubrication should be solved. Although all of the detail of the system as shown in FIG. 2 is not shown in the simplified version of FIG. 4, it will be understood that all of the detail of the system shown in FIG. 2 also may be in the simplified system of FIG. 4, except that the novel pressure reducing device 409 is included between sump and a low pressure point of the refrigeration system 21.

Figure 5:
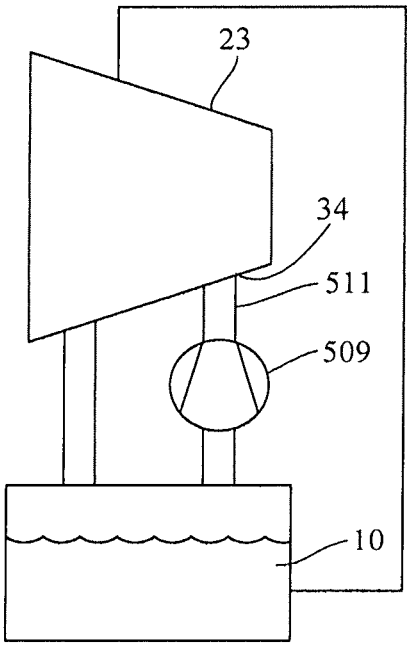
FIG. 5 a simplified schematic of an embodiment of the compressor lubrication circuit of the present invention utilizing an auxiliary compressor.

The pressure reduction in the oil sump can be achieved in different ways. FIG. 5 depicts a simplified version of an embodiment of the present invention, again using a simplified schematic for illustration of the invention. Although all of the detail of the system as shown in FIG. 2 is not shown in the simplified version of FIG. 5, it will be understood that all of the detail of the system shown in FIG. 2 also may be in the simplified system of FIG. 5, except that a pressure reducing device 509 is included between sump and a low pressure point of the refrigeration system 21. In FIG. 5, the pressure reducing device is a small additional "auxiliary" compressor 509 positioned between sump 10 and compressor inlet 34 to draw refrigerant gas from sump 10 while reducing the pressure of refrigerant gas in the sump. Auxiliary compressor 509 has its suction side connected to the gas volume of oil sump 10 and its discharge side connected, for example, to compressor inlet 34 of main compressor 23. In this implementation, the capacity of auxiliary compressor 509 is controlled in such a way that it keeps the refrigerant pressure in oil sump 10 at a pre-selected value as described above (e.g. corresponding to the saturated pressure of the refrigerant fluid at 20° C. in the above example). As discussed above and recognized by those skilled in the art, the discharge of auxiliary compressor 509 can also be connected to any lower pressure point in refrigeration system 21, such as evaporator 27 or any point between evaporator 27 and compressor inlet 34 as shown in FIG. 1.

While the use of auxiliary compressor 509 is conceptually simple, it also has some drawbacks. Besides its additional manufacturing and operational cost, auxiliary compressor 509 is also a mechanical component with possible reliability and maintenance issues. In addition, its operational costs, specifically energy consumption, may be significant. Furthermore, in circumstances of variable operating conditions, the capacity control related to the use of such an auxiliary compressor 509 may be problematic. However, the use of auxiliary compressor 509 in refrigeration system 21 is a viable option to reduce refrigerant in sump 10.

Figure 6:
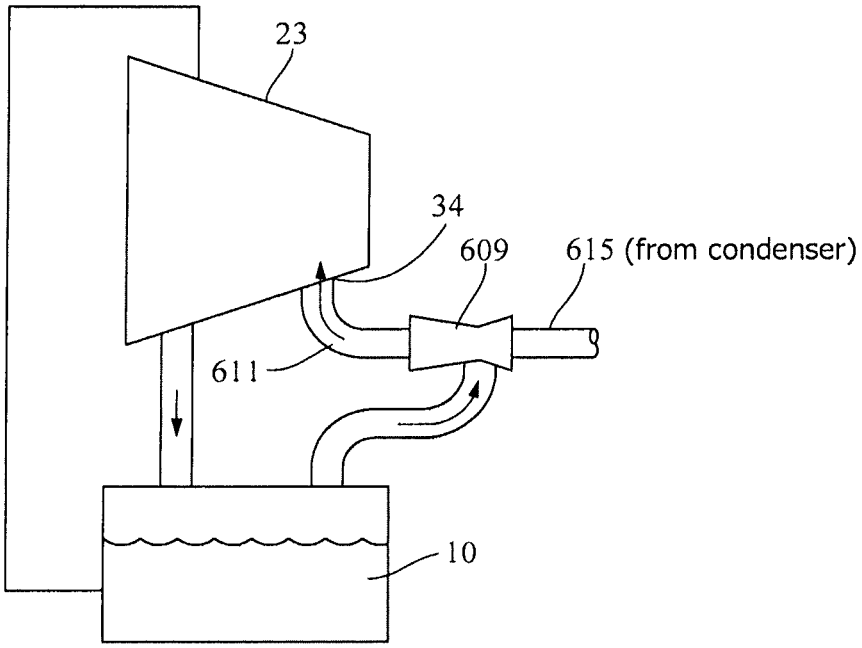
FIG. 6 is a simplified schematic of an embodiment of the compressor lubrication circuit of the present invention utilizing an ejector pump.

In another embodiment depicted in FIG. 6, a simplified schematic of an embodiment of the present invention, an ejector pump 609, also referred to as a jet pump, is depicted as the pressure reducing device associated with sump 10. Again, all of the detail of the system as shown in FIG. 2 is not shown in the simplified version of FIG. 6, and it will be understood that all of the detail of the system shown in FIG. 2 also may be in the simplified system of FIG. 6, except that ejector pump 609 is positioned between sump 10 and a low pressure point of the refrigeration system. In FIG. 6, high pressure gas from conduit 615, which is in fluid communication with condenser 25, after passing through an expansion valve (not shown), if required, is used to provide the energy to operate ejector pump 609. At the ejector outlet, the mixture of this high pressure refrigerant fluid from condenser 25 and the low pressure gas pumped from oil sump 10 is sent to a low pressure point in the refrigeration system, preferably the evaporator. Although shown in FIG. 6 as in direct fluid communication with compressor inlet 34 via conduit 611 (for consistency with FIGS. 4 and 5), the low pressure point may be at any intermediate location between compressor 23 and evaporator 27 that is at a low pressure, as previously discussed. The advantage of this embodiment, using an ejector pump, is that it avoids moving parts such as found with the use of auxiliary compressor 509 of FIG. 5. This embodiment does suffer from a drawback, because ejector pumps 609 usually have a relatively poor efficiency, and thus penalize the energy efficiency of the refrigeration system. Nevertheless, the use of ejector pump 609 in refrigeration system 21 is a viable option to reduce refrigerant in sump 10, while allowing the lubrication system to operate with higher temperature systems seen in heat pump applications.

Figure 7:
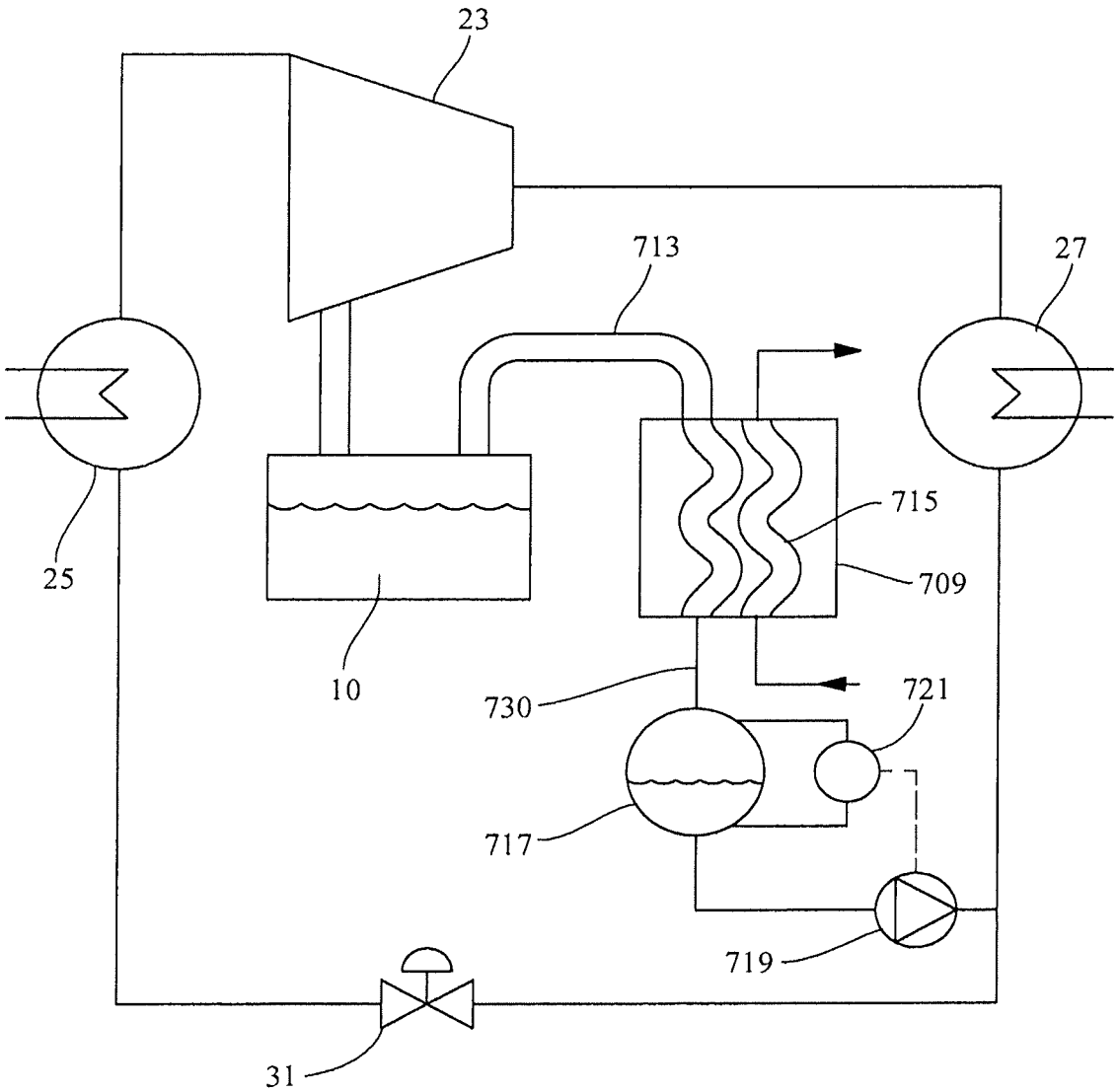
FIG. 7 is a simplified schematic of an embodiment of the compressor lubrication circuit of the present invention utilizing an auxiliary condenser and liquid pump.

In a preferred embodiment of the present invention depicted in FIG. 7, a simplified schematic of an embodiment of the present invention, an auxiliary condenser 709 is depicted as the pressure reducing device associated with sump 10. Again, all of the detail of the system as shown in FIG. 2 is not shown in the simplified version of FIG. 7, and it will be understood that all of the detail of the system shown in FIG. 2 also may be in the simplified system of FIG. 7, except that auxiliary condenser 709 is included between sump 10 and a low pressure point of the refrigeration system. In FIG. 7, refrigerant gas from sump 10 is in fluid communication with auxiliary condenser 709 via conduit 713. Gas from sump 10 enters auxiliary condenser 709 where it is in heat exchange relationship with a cooling fluid flowing through cooling circuit 715. Cooling fluid in cooling circuit 715 cools the refrigerant gas, condensing it from a gas to a liquid, the liquid refrigerant being sent to liquid storage space 717 via conduit 730.

The auxiliary condenser 709 is selected to provide a condensing pressure equal to the desired refrigerant pressure in oil sump 10. This requires the refrigerant gas in auxiliary condenser 709 to be cooled by a cooling fluid at a temperature lower than the cold source of the heat pump. For example, if the desired condensing pressure in the auxiliary condenser 709 corresponds to a 20° C. (68° F.) saturation temperature, auxiliary condenser 709 preferably is cooled with water having an entering temperature of about 12° C. (about 54° F.) and a leaving temperature of about 18° C. (about 64° F.). The cooling water may be provided from any available chilled water source as well as from ground water within the desired temperature range. The condensing pressure in auxiliary condenser 709 may be controlled by varying the flow and/or temperature of the cooling fluid through cooling circuit 715 of auxiliary condenser 709 to maintain the desired gas pressure in oil sump 10. As depicted in FIG. 7, liquid storage space 717 for condensed refrigerant may be a separate vessel as shown, or may be a separate storage space integral to auxiliary condenser 709.

Per the principle of the system, liquid storage space 717 is at a lower pressure than the compressor inlet and the evaporator in the main refrigerant circuit. To avoid accumulation of liquid refrigerant in liquid storage space 717, refrigerant must be pumped from storage space 717 back to refrigerant system 21 by pump 719 that is controlled by liquid level sensor 721. This pump 719 has its suction side connected to fluid storage space 717 and its discharge side in fluid communication with refrigerant system 21. To reduce the head and the absorbed power of the pump, it is preferred to set the pump discharge to a low pressure portion of the main refrigerant circuit 21. While this low pressure region may be compressor inlet 34, as previously discussed with regard to FIGS. 3-6, FIG. 7 depicts the low pressure region as the conduit between expansion valve 31 and evaporator 27, although refrigerant may be sent to the low pressure region at any convenient point, such as between expansion valve 31 and compressor suction 34. It is also normally desired to avoid sending refrigerant liquid directly into compressor suction 34 (inlet) from liquid storage space 717 to avoid liquid flooding of compressor 23. Therefore, a location along the conduit between expansion valve 31 and evaporator 27 is a desirable and preferred refrigerant input, as is supplying this liquid refrigerant to evaporator 27, such as at the liquid inlet of evaporator 27. More specifically, if evaporator 27 is of the dry-expansion technology (either shell and tube or plate heat exchanger), then it is desirable to discharge the liquid refrigerant into the main liquid line at the evaporator inlet. If evaporator 27 is of the flooded type, falling film or hybrid falling film, an alternative is to discharge the liquid directly in the evaporator shell, at a location away from the suction pipe to avoid liquid carry-over to compressor inlet 34.

Means also is provided to control the operation of liquid pump 719, depicted in FIG. 7 as liquid level sensor 721. A desired arrangement is to have fluid storage space 717 located at the outlet of auxiliary condenser 709, allowing liquid refrigerant to flow by gravity from auxiliary condenser 709 into storage space 717. This volume can either be included in the same shell as the auxiliary condenser 709, or as a separate vessel. The liquid level in this storage space is sensed by a liquid level sensor which includes a control loop, depicted simply as liquid level sensor 721. This control loop portion of liquid level sensor 721 manages the operation of liquid pump 719 in order to keep the liquid level in the fluid storage space 717 within predetermined, pre-set acceptable limits. Liquid pump 719 can either have a variable speed drive, with the speed being controlled by the control loop of liquid level sensor 721, or it may simply have an ON/OFF operation sequence, also under control of the same control loop.

Figure 13:
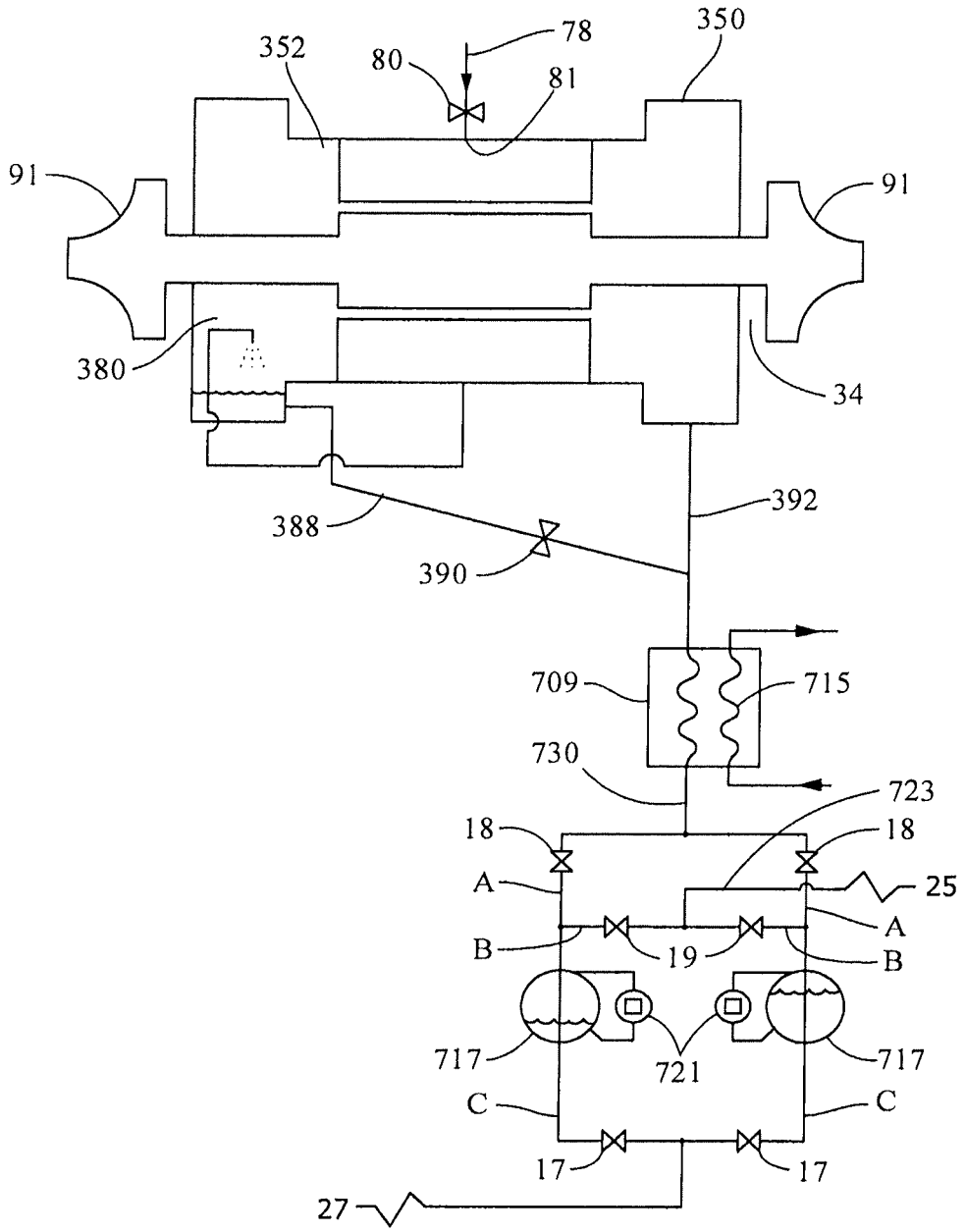
FIG. 13 is a modification of the motor cooling arrangement of FIG. 12 utilizing a pair of vessels connected to the main condenser to return fluid from the auxiliary condenser to the evaporator.

In another embodiment, a conventional mechanical pump 719 may be replaced by a purely static pumping system. In a variation to this embodiment, the static pumping system may utilize an ejector pump 609 powered by high pressure gas from main condenser 25. A mixture of pumped liquid from fluid storage space 717 and of high pressure gas from main condenser 25 is returned to evaporator 27. In still another variation to this embodiment, two fluid storage vessels 717 may be located below auxiliary condenser 715, each having an inlet (A) connected to the discharge port of auxiliary condenser 709 to receive condensed refrigerant liquid, an inlet (B) connected to receive gas from evaporator or main condenser 25, and each having outlet (C) connected to evaporator 27. Each of these connections has an automatic valve that can be opened or closed. The system is operated in "batches", being activated by a control circuit using principles known to those skilled in the art. This system also is represented in FIG. 13, as associated with the cooling of a semi-hermetic motor.

Any of these embodiments enable removal of refrigerant from oil in a lubricated compressor, and is not limited to use with a centrifugal compressor. The present invention may also find use with reciprocating compressors, scroll compressors and turbines as used in ORC systems, each of which requires lubrication. An auxiliary compressor 509 or ejector pump 609 may advantageously be used to remove refrigerant from oil in these units, as described above. These components may require significant power consumption or otherwise penalize system efficiency. An auxiliary condenser 709 has the further advantage of not requiring power to operate, assuming that water at the desired temperature is available. But it also requires a liquid pump 719 to transfer condensed refrigerant liquid to refrigerant system 21 at or near evaporating pressure. Although this does require a small amount of power, it is significantly less than the power required for operation of an auxiliary compressor 509, and there is no penalty to overall system efficiency such as with operation of ejector pump 609.

The basic pressure reducing devices described above with reference to FIGS. 4-7 to separate refrigerant from lubrication systems may also be adapted for use in refrigeration circuits to extend the operational limits of refrigerant fluid for cooling semi-hermetic motors. These pressure reducing devices 409 can advantageously be utilized in heat pump systems which typically operate at higher temperatures than chiller systems. These pressure reducing devices 409 extend the motor cooling capability of the refrigerant, permitting the use of chiller system equipment for heat pump applications. In these systems, refrigerant is utilized to cool the motor and the motor cavity from heat generated by operation of the motor. The pressure in the motor housing and in the coil surrounding the motor stator without such pressure reducing devices is nearly equal to or slightly higher than the pressure in the evaporator. But, pressure reducing devices are controlled to maintain the pressure in the motor cavity at a preset value below that of the compressor inlet and preferably lower than that of the evaporator so that refrigerant gas can be drawn through the housing. For a system operating in heat pump applications, it is desired to maintain the pressure in the motor cavity at a preset value below the pressure at the compressor inlet, for example, at a saturation temperature of 20° C. corresponding to the desired pressure for a given refrigerant. These values typically correspond to the temperatures at which the compressor is validated when the system operates as a water chiller system.

Figure 8:
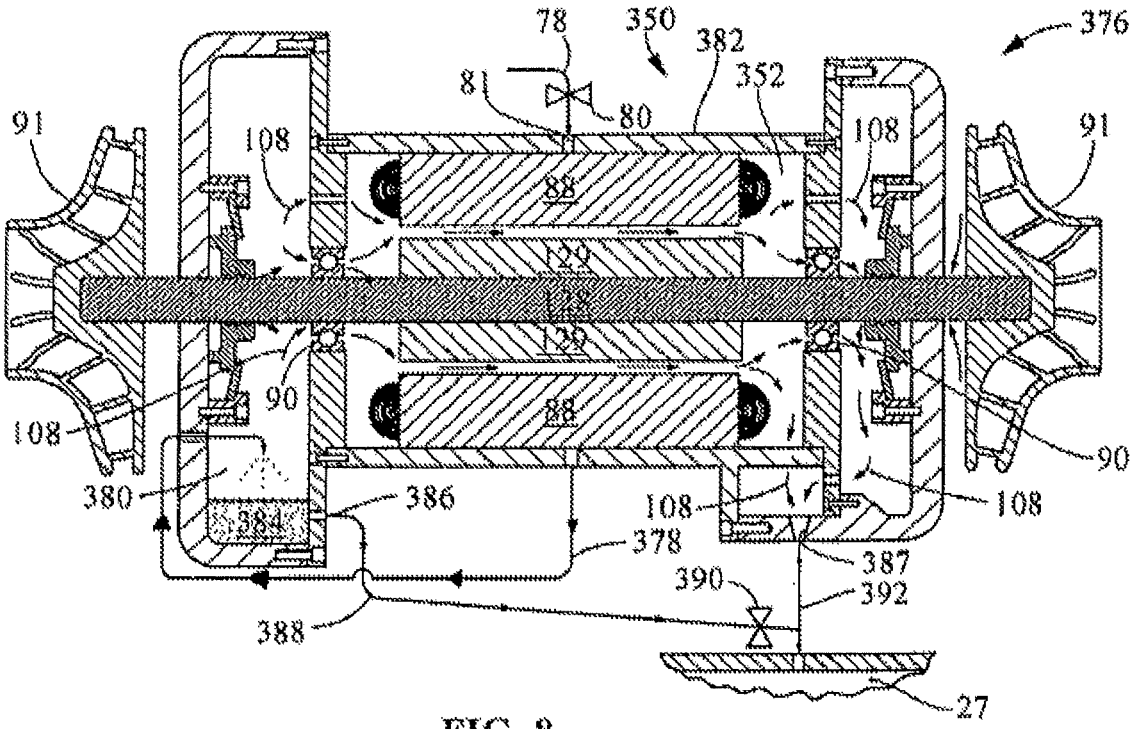
FIG. 8 is a cross-sectional view of a prior art cooling scheme utilized for cooling a compressor motor having a centrifugal compressor attached at either end of the rotor shaft.

FIG. 8 depicts a prior art cooling scheme utilized for cooling a semi-hermetic motor 350 driving a compressor, as set forth in prior art patent application WO 2012/082592 A1 assigned to the assignee of the present invention. In the cross sectional representation of motor of FIG. 8, a centrifugal compressor 376 is shown with an impeller 91 attached to either end of motor shaft 128 in a preferred embodiment, but the invention is not so limited, as the motor cooling scheme may be utilized with any type of compressor driven by a semi-hermetic motor in a refrigeration circuit and does not require a compressor attachment at both ends of shaft 128 as depicted in FIG. 8. In FIG. 8, liquid refrigerant from the condenser is provided via a line 78 to an expansion device 80 which reduces the pressure and temperature of the liquid refrigerant, preferably converting it to a mist, as previously defined, a mixture of refrigerant liquid droplets and gas. The refrigerant mixture then enters motor inlet 81 passing into motor housing 382, which is hermetically sealed to prevent gas (refrigerant) leakage across its boundaries.

The operation of motor 350, which comprises a motor stator 88 and motor rotor 129, generates heat. Motor stator 88, motor rotor 129 and shaft 128 are positioned in a cavity 352 within motor housing 382. Rotor 129 is attached to shaft 128, and an alternating electrical field in motor stator 88 rotates rotor 129 and shaft 128. Also depicted in FIG. 8 are bearings 90 at either end of motor shaft 128, which support rotor 129 during operation. In FIG. 8, these bearings 90 are depicted as mechanical bearings, but, as recognized by those skilled in the art, also may be magnetic bearings. Like motor 350, magnetic bearings are operated by strong magnetic fields and also generate heat. Thus, heat is generated within motor housing 382 whether bearings 90 are magnetic bearings or mechanical bearings. The refrigerant introduced into motor housing 382 through motor inlet 81 is used to remove heat from both motor 350 and bearings 90.

In this particular embodiment, after entering motor housing 382 through motor inlet 81, refrigerant passes into a coil that surrounds motor stator, the refrigerant removing heat from motor stator 88. The refrigerant then passes into a line 378 that conveys the refrigerant to a secondary cavity 380. The refrigerant entering secondary cavity 380 may be a mist, that is, it is refrigerant in two phases. The liquid phase 384 separates by gravity to the bottom of secondary cavity 380 and is sent to evaporator 27 through a first motor housing outlet 386 via line 388. Line 388 may include restriction 390, such as a fixed orifice or control valve to control the flow of refrigerant liquid. Restriction 390 prevents refrigerant gas from passing out of the motor via this path together with the liquid phase. The remaining refrigerant entering secondary cavity 380 passes through apertures 108 as a gas and reenters motor cavity 352 wherein it passes between stator 88 and rotor/shaft 128/129, as depicted by the arrows in FIG. 8, removing heat from these components. Some of the refrigerant also passes over bearings 90 removing heat and cooling them. The refrigerant traverses the gap between stator 88 and motor/rotor 129/128 as it removes heat from them. The refrigerant gas then is cycled back to evaporator 27 through a second motor housing outlet 387 via conduit 392 either directly or after passing through and around bearings 90. This is one of the many possible ways to circulate refrigerant in a motor to cool its various components, using a combination of liquid, gas, or two-phase refrigerant. While a variety of configurations is possible, prior art systems have in common that the pressure in the motor housing is close to the evaporating pressure of the refrigeration circuit. In the prior art cooling arrangement, the pressure in motor cavity 352 and in the coil surrounding stator 88 is nearly equal to the pressure in evaporator 27. One source of heat in the motor is the gas friction power generated by the speed of the rotating parts. This power increases with gas density. Thus, a higher gas pressure in the motor 350 generates higher friction losses that contribute to further heating of the motor. Also the gas temperature in the motor housing is equal to or greater than the saturated temperature and pressure of the refrigerant within the motor housing. Finally, the evaporation temperature of the refrigerant in the coil surrounding the stator is at least equal to the saturated pressure in the motor housing. The result is that when the temperature and the pressure increase in the evaporator, the temperature and pressure in the motor also increases. For this reason, the prior art cooling arrangement, although useful in semi-hermetic compressor applications used for water chillers, is not utilized in high temperature heat pump applications because required cooling cannot be provided by maintaining these temperature and pressure settings.

A cooling arrangement using refrigerant can be successful when the pressure of the refrigerant in the motor cavity is lower than the pressure at compressor inlet 34 or the pressure of evaporator 27. Lowering the pressure of the refrigerant in the motor cavity 352 reduces the gas friction losses and improves motor cooling. When operating at heat pump conditions, an ideal target for pressure reduction is to set the pressure of the refrigerant from the motor cavity at a value consistent with the validated range of the same standard machine when operating as a water chiller. For instance, if a given type of compressor and associated semi-hermetic motor is validated in chiller applications for a maximum evaporation temperature of 20° C. with a given refrigerant, the target will be to set the motor cavity to 20° C. saturation temperature in heat pump operation. Of course, it is not enough to guarantee that the motor cooling will be acceptable. Many other parameters must be checked and resolved, such as design pressure, shaft power, bearing loads, etc; but a solution to motor cooling problems is provided.

The pressure reduction of refrigerant in the motor cavity 352 may be achieved in different ways. This pressure reduction may be achieved using the same equipment that was utilized for pressure reduction in oil sump 10, described above.

Figure 9:
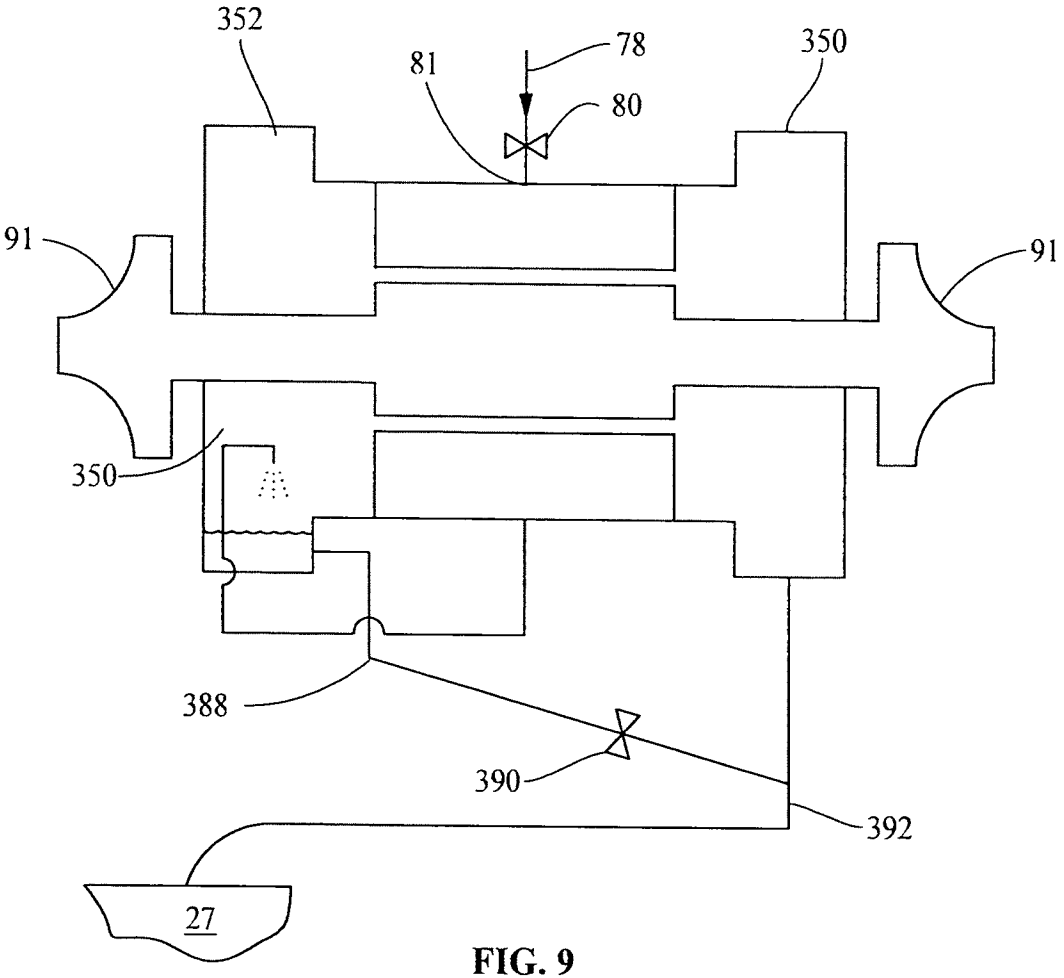
FIG. 9 Prior Art
FIG. 9 is a simplified schematic of the motor and compressor depicted in FIG. 8.

FIG. 9 is a simplified version of FIG. 8 showing the circuitry from motor inlet 81 for the refrigerant fluid through motor 350. Liquid refrigerant in line 388 passes through restriction 390 to conduit 392 which channels the refrigerant to evaporator 27.

Figure 10:
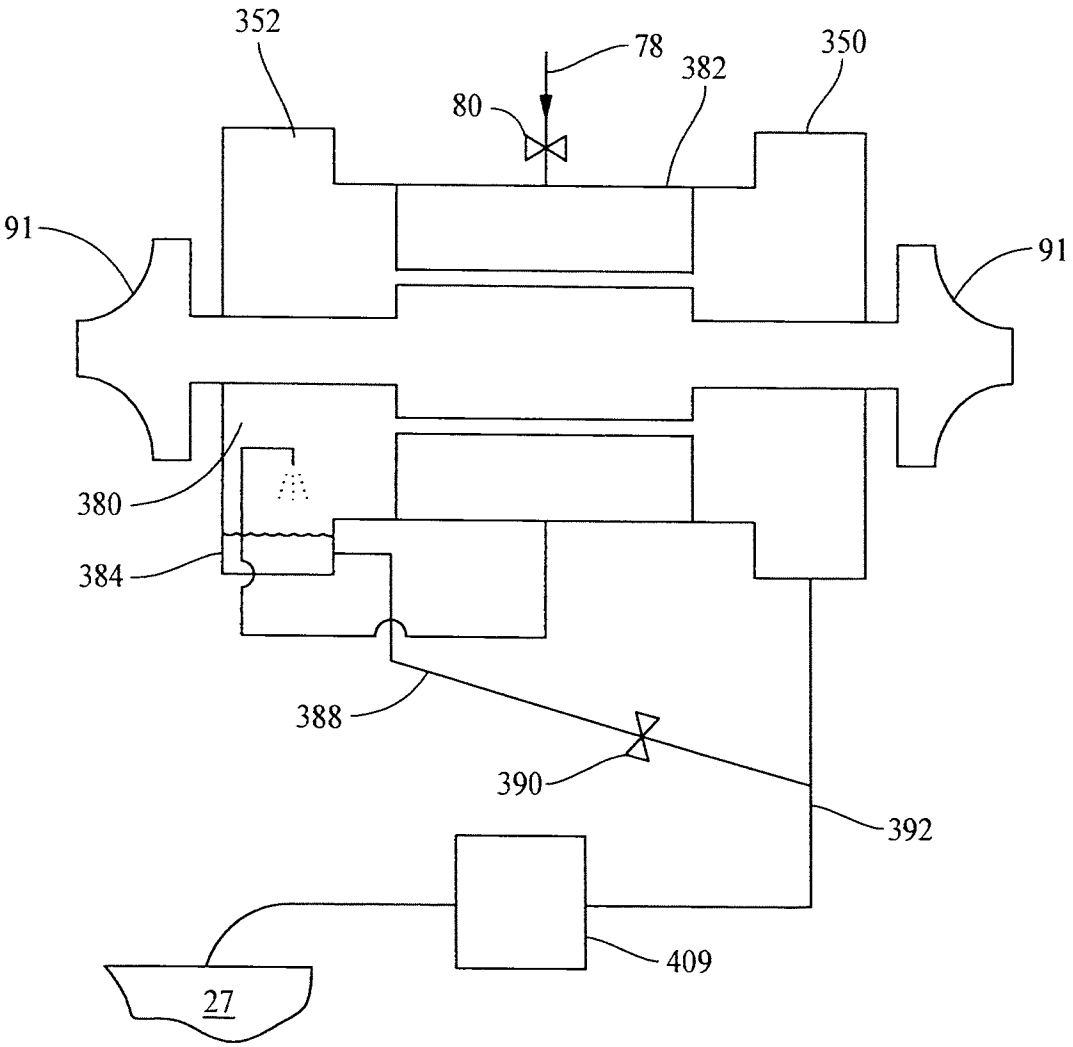
FIG. 10 is a simplified schematic for the motor depicted in FIG. 8 of an embodiment of the present invention using a motor cooling arrangement having a pressure reducing device in communication with the motor cavity and intermediate a low pressure point in the refrigeration system.
Figure 14:
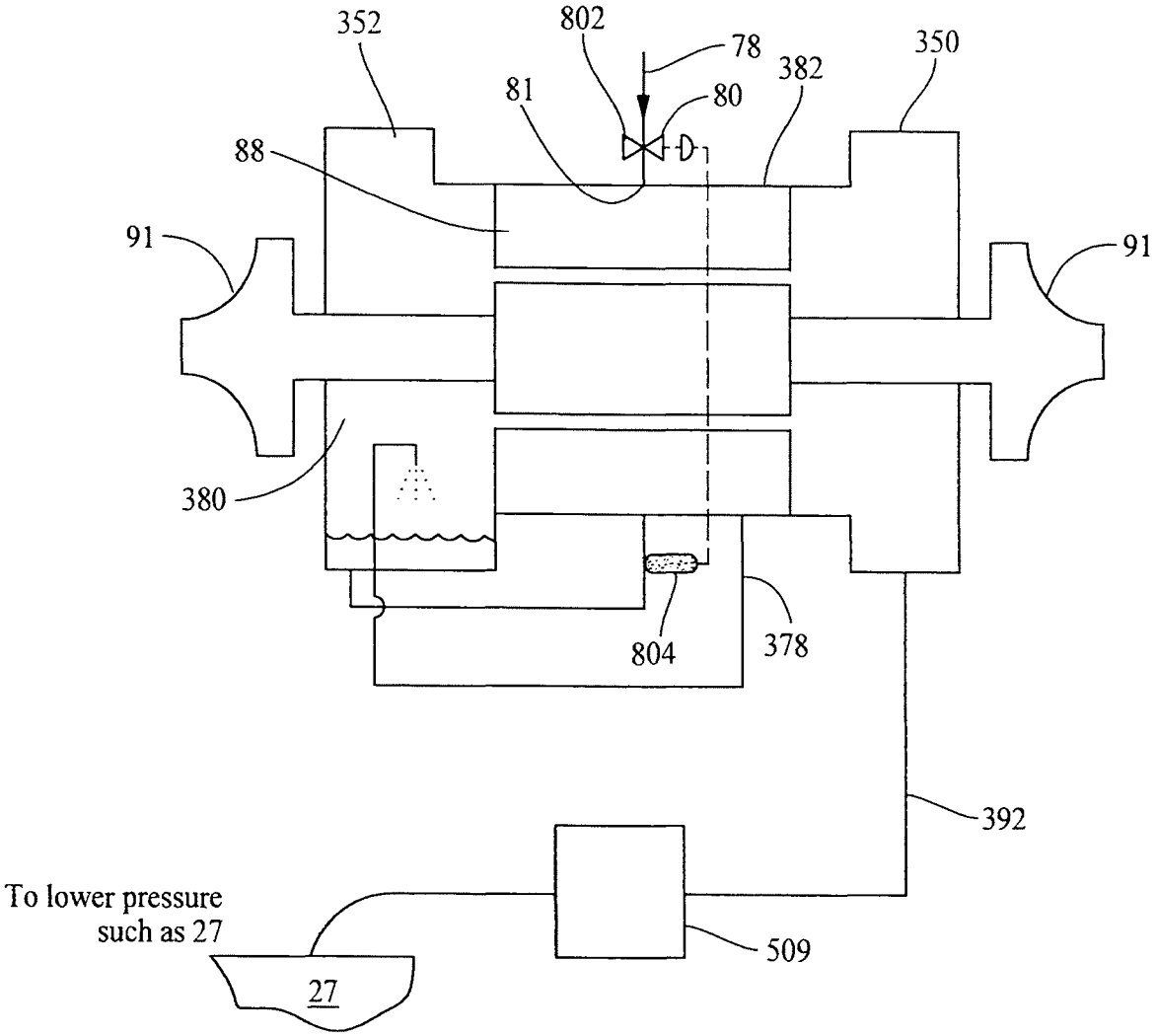
FIG. 14 is a modification of the motor cooling arrangement of FIG. 10 utilizing an auxiliary compressor in conjunction with a thermal expansion valve instead of a fixed orifice.

FIG. 10 depicts an embodiment of the present invention, again using a simplified schematic. Although all of the detail of the system as shown in FIG. 8 is not shown in the simplified version of FIG. 10, it will be understood by one skilled in the art that all of the detail of the system shown in FIG. 8 with regard to the motor 350 also may be included in the embodiment of the invention depicted in FIG. 10. This omitted detail is not required to understand the improvement depicted in FIG. 10. Generically, FIG. 10 depicts a pressure reducing device 409 in communication with motor cavity 352, pressure reducing device 409 being intermediate a low pressure point in the refrigeration system and the motor cavity. In FIG. 10, this low pressure point in refrigeration system 10 may be evaporator 27 as shown, but it also may be the compressor suction (i.e. inlet 34) or other low pressure point. In FIG. 14, pressure reducing device 409 is a small additional "auxiliary" compressor 509 positioned between motor 350 and the evaporator 27 or compressor inlet 34 to draw refrigerant from motor cavity 352. In the arrangement depicted in FIG. 14, a schematic diagram in accordance with FIG. 10 desirably should not be adopted, as the arrangement of FIG. 10 contemplates some liquid flowing though orifice 390 into the inlet of the pressure reducing device 409, which is not acceptable when this device is an auxiliary compressor such as contemplated in FIG. 14, with associated potential of compressor flooding. To avoid this, means must be provided to avoid sending an excessive amount of liquid through the orifice at motor inlet 81. An example of such implementation is set forth in FIGS. 14 and 15, FIGS. 14 and 15, differing in how the fluid entering motor cavity through expansion valve 802 is controlled. In FIG. 14, the circuit of FIG. 10 is modified as follows: the fixed orifice at motor inlet 81 set forth in FIG. 10 includes a thermostatic expansion valve 802 used to reduce the refrigerant flow to the stator coil. The fixed orifice 390 set forth in FIG. 10 is replaced by the thermostatic expansion valve 802 used to reduce the refrigerant flow to the stator 88. The sensor 804, which may be a temperature sensor, associated with expansion valve 802 may be located on line 378, or at any convenient location on the motor housing. With this arrangement, only some gas exits from motor housing 382 and enters cavity 380 through line 378. The liquid phase 384 is eliminated and liquid line 388 may be removed as liquid in secondary cavity 350 is eliminated, as shown in FIG. 14. Since a reduced amount of refrigerant enters housing 382 through expansion valve 802, a reduced amount or refrigerant gas exits from compressor housing 382 through line 392, ensuring that there are no liquid droplets at the suction of the auxiliary compressor, as desired.

Figure 15:
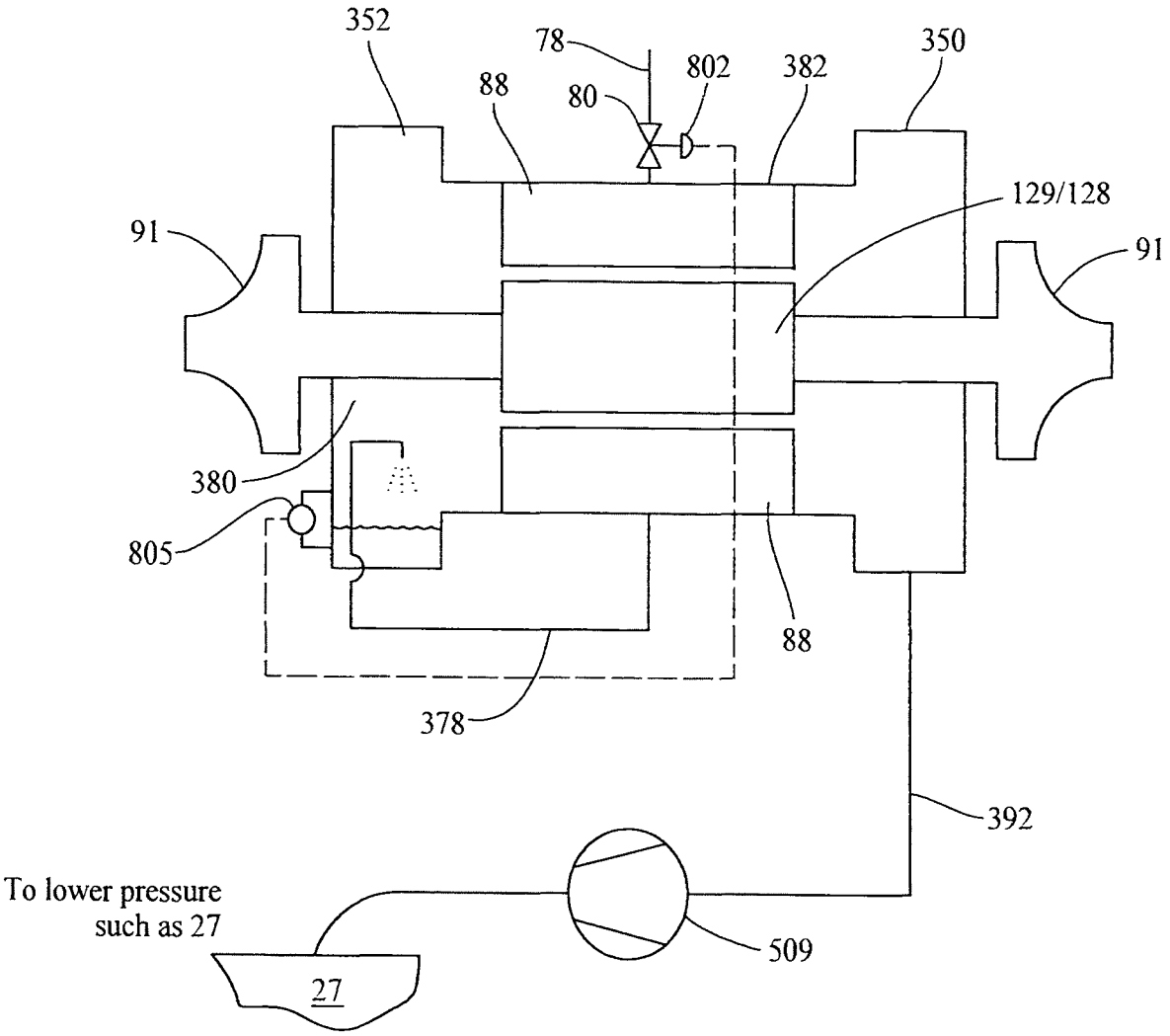
FIG. 15 is a further embodiment of the motor cooling arrangement of FIG. 10.
Figure 16:
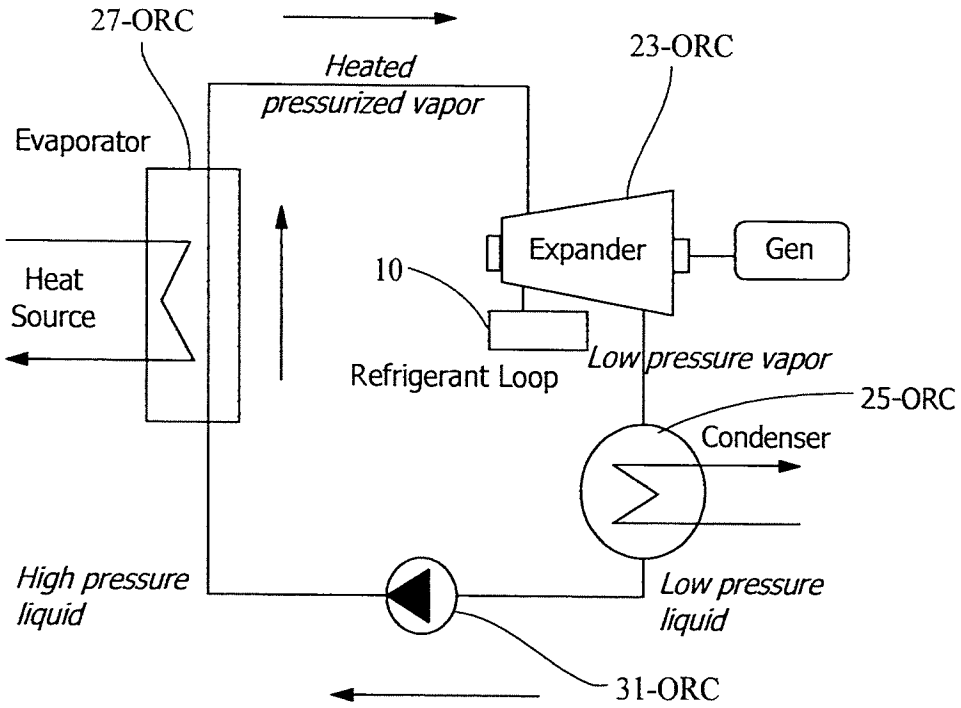
FIG. 16 Prior Art
FIG. 16 is a prior art schematic of an organic Rankine Cycle system, depicting operation in reverse to the system depicted in FIG. 1.

In this implementation, the capacity of pressure reducing device 409 (auxiliary compressor 509 in FIG. 15) is controlled in such a way that it keeps the pressure in motor cavity 352 at a pre-selected value. This preselected value may correspond to a maximum evaporation temperature for a given refrigerant, which may be the same temperature for a compressor operating under heat pump conditions as a standard compressor when operating as a water chiller. For example, the pressure may be set to correspond to a temperature of 20° C. As discussed above and recognized by those skilled in the art, the discharge of pressure reducing device 409 such as an auxiliary compressor 509 can also be connected to any lower pressure point in refrigeration system 21, such as evaporator 27 as shown in FIG. 1. In the schematic of FIG. 15, liquid does pool in secondary cavity 380, but the level is monitored by level control 805 which in turn controls thermostatic expansion valve 802 which controls the refrigerant entering motor housing 382.

While the use of the auxiliary compressor is conceptually simple, it also has some drawbacks. Besides its additional manufacturing and operational cost, the auxiliary compressor is also a mechanical component with possible reliability and maintenance issues. In addition, its operational costs, specifically energy consumption, may be significant. Furthermore, in circumstances of variable operating conditions, the capacity control related to the use of such an auxiliary compressor may be problematic. However, the use of auxiliary compressor in refrigeration system 21 is a viable option to reduce refrigerant pressure in the motor cavity 352.

Figure 11:
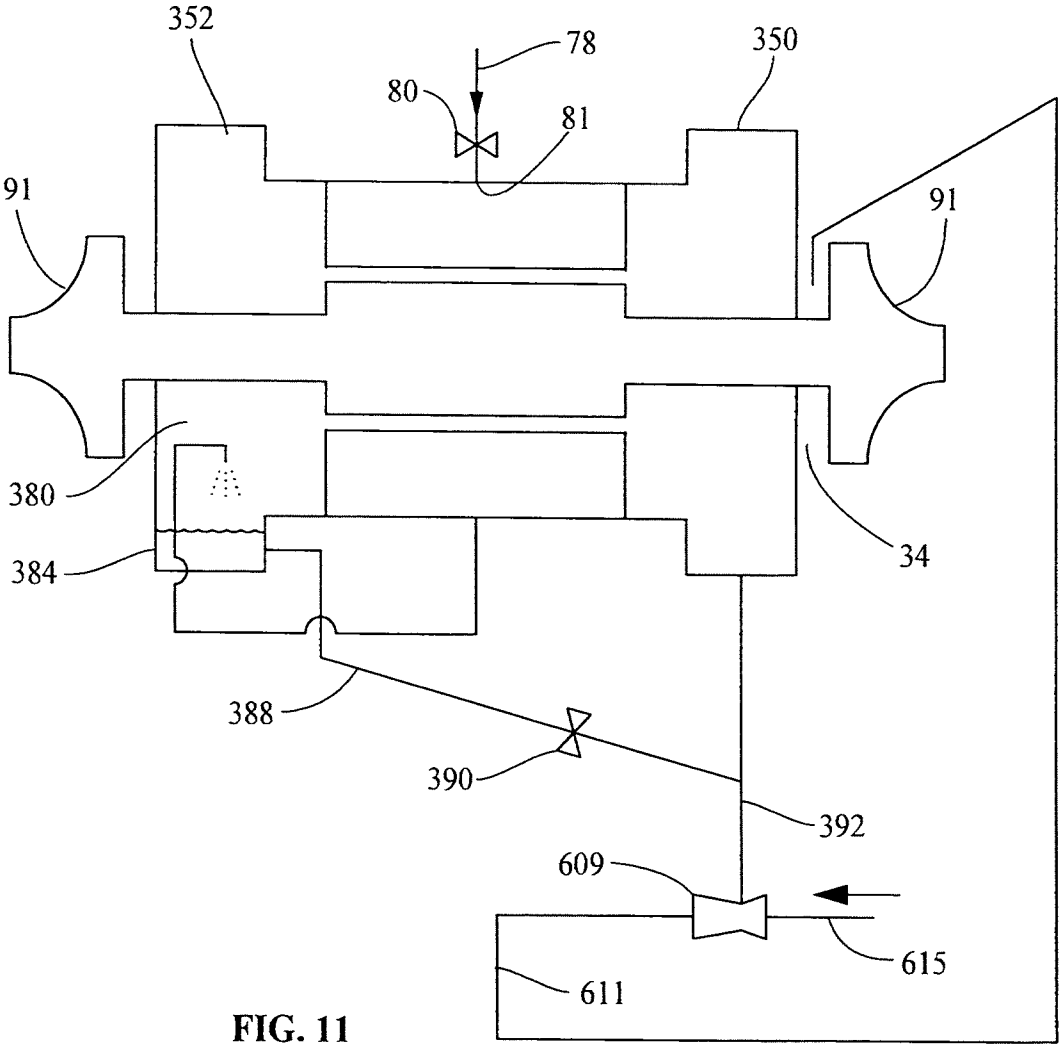
FIG. 11 is a simplified schematic of an embodiment of FIG. 10 for the motor cooling arrangement of the present invention utilizing an ejector pump.

In another embodiment depicted in FIG. 11, a simplified schematic of an embodiment of the present invention, an ejector pump 609, also referred to as a jet pump, is depicted as pressure reducing device 409 associated with motor 350. Again, all of the detail of the system as shown in FIG. 8 is not shown in the simplified version of FIG. 11, and it will be understood that all of the detail of the system shown in FIG. 8 also may be in the simplified schematic shown in FIG. 11, except that ejector pump 609 is positioned between motor 350 and motor cavity 352 and a low pressure point of the refrigeration system. In FIG. 11, high pressure gas from conduit 615, which is in fluid communication with condenser 25, after passing through an expansion valve, if required, is used to provide the energy to operate ejector pump 609. At the ejector pump outlet, the mixture of this high pressure refrigerant fluid from condenser 25 and low pressure refrigerant pumped from motor 350 is sent to a low pressure point in the refrigeration system, preferably evaporator 27. The refrigerant may be in direct fluid communication with compressor inlet 34 via conduit 611 as shown in FIG. 11, or the low pressure point may be at any intermediate location between evaporator inlet and compressor inlet 34. The advantage of this embodiment is that it avoids moving parts such as found with the use of auxiliary compressor 509 discussed above. The embodiment utilizing an ejector pump 609 such as depicted in FIG. 11 does suffer from a drawback, as ejector pumps 609 usually have a relatively poor efficiency, and thus penalize the energy efficiency of the refrigeration system. Nevertheless, the use of ejector pump 609 in refrigeration system 21 is a viable option to lower refrigerant pressure in motor 350 and return the refrigerant to the refrigerant circuit, while allowing the refrigerant to cool the motor as it operates with higher temperature systems seen in heat pump applications.

Figure 12:
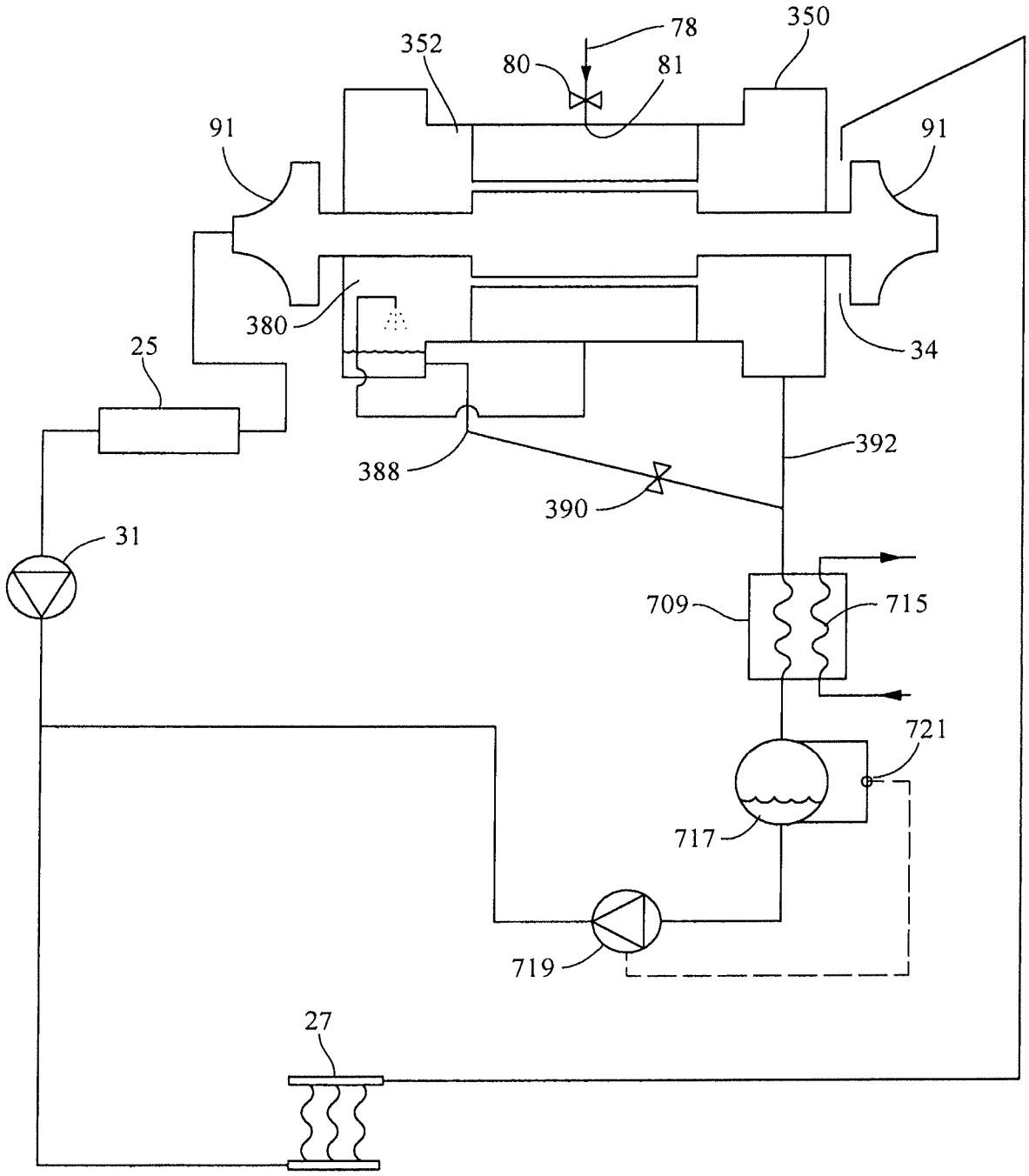
FIG. 12 is a simplified schematic of an embodiment of FIG. 10 for the motor cooling arrangement of the present invention utilizing an auxiliary condenser.

In a preferred embodiment of the present invention depicted in FIG. 12, a simplified schematic of an embodiment of the present invention, a small auxiliary condenser 709 is depicted as the pressure reducing device associated with motor 350 and motor cavity 352. Again, all of the detail of the system as shown in FIG. 8 is not shown in the simplified schematic of FIG. 12, and it will be understood that all of the detail of the system shown in FIG. 8 also may be in the simplified system of FIG. 12, except that auxiliary condenser 709 is included between motor 350 and a low pressure point of refrigeration system 21. In FIG. 12, refrigerant from motor 350 is in fluid communication with auxiliary condenser 709 through line 388 and restriction 390 as well as through conduit 392. Refrigerant from motor 350 enters auxiliary condenser 709 where it is in heat exchange relationship with a cooling fluid flowing through cooling circuit 715 of auxiliary condenser 709. Cooling fluid in cooling circuit 715 cools the refrigerant gas, condensing it from a gas to a liquid that is sent to liquid storage space 717.

The auxiliary condenser 709 is selected to provide a condensing pressure equal to the desired refrigerant pressure in the cavity of motor 350. This requires the refrigerant gas in auxiliary condenser 709 to be cooled by a cooling fluid at a temperature lower than the cold source of the heat pump. For example, if the desired condensing pressure corresponds to a 20° C. (68° F.) saturation temperature, auxiliary condenser 709 preferably is cooled with water having an entering temperature of about 12° C. (about 54° F.) and a leaving temperature of about 18° C. (about 64° F.). The cooling water may be provided from any available chilled water source as well as from ground water within the desired temperature range. The condensing pressure may be controlled by varying the flow and/or temperature of the cooling fluid through cooling circuit 715 of auxiliary condenser 709 to maintain the desired gas pressure in the cavity of motor 350. As depicted in FIG. 12, fluid storage space 717 may be a separate unit as shown, or may be a separate storage space integral to auxiliary condenser 709. Regardless of the location of fluid storage space 717, liquid refrigerant in fluid storage space may be pumped conveniently from storage space 717 by pump 719 that is activated by liquid level sensor 721.

Once refrigerant from the cavity of motor 350 has been condensed and sent to fluid storage space 717, it may be pumped back to refrigerant system 21 by liquid refrigerant pump 719 having its suction side connected to fluid storage space 717 and its discharge side in communication with a low pressure region in refrigerant system 21 to reduce the head and the absorbed power of the pump. While this low pressure region may be the compressor inlet, as previously discussed with regard to FIGS. 10 and 11, it is not desirable to send liquid to the compressor inlet, as this could flood the compressor with liquid refrigerant. Thus, refrigerant pump desirably should cycle to a low pressure region of the system such as to the conduit between expansion valve 31 and evaporator 27, (see FIG. 1) or to evaporator 27, such as at the liquid inlet of evaporator 27, although refrigerant may be sent to the low pressure region at any convenient point. As previously noted, this reduces the head and the absorbed power of the pump, as it is supplying this liquid refrigerant to evaporator 27. More specifically, if evaporator 27 is of the dry-expansion technology type (either shell and tube or plate heat exchanger), then it is desirable to discharge the liquid refrigerant into the main liquid line at the evaporator inlet. If evaporator 27 is of the flooded type, falling film or hybrid falling film, an alternative is to discharge the liquid directly in the evaporator shell, at a location away from the suction pipe to avoid liquid carry-over.

Means also is provided to control the operation of liquid pump 719, depicted in FIG. 12, means being identified as liquid level sensor 721. A desired arrangement is to have fluid storage space 717 located at the outlet of auxiliary condenser 709, allowing liquid refrigerant to flow by gravity to fluid storage space 717. This volume can either be included in the same shell as the auxiliary condenser 709, or as a separate vessel as depicted in FIG. 12. The liquid level in fluid storage space 717 is sensed by a liquid level sensor 721 which includes a control loop, depicted simply as liquid level sensor 721. This control loop portion of liquid level sensor 721 manages the operation of liquid pump 719 in order to keep the liquid level in the fluid storage space 717 within pre-set acceptable limits. Liquid pump 719 can either have a variable speed drive, with the speed being controlled by the control loop of liquid level sensor 721, or it may simply have an ON/OFF operation sequence, also under control of the same control loop. Pump 719 returns refrigerant liquid back to refrigeration system 21. In order not to flood compressor inlet 34 with liquid, refrigerant may be returned to refrigeration system anywhere between expansion device 31 and evaporator 27 as shown in FIG. 12, including evaporator 27. In FIG. 12, the centrifugal compressor is a two-stage compressor, so that low pressure gas refrigerant is input into the first stage compressor inlet and high pressure gas is discharged into condenser 25 from the second stage compressor.

In another embodiment, a conventional mechanical pump may be replaced by a purely static pumping system. In a variation to this embodiment, the static pumping system may utilize an ejector pump powered by high pressure gas from main condenser 25. A mixture of pumped refrigerant liquid from fluid storage space 717 and of high pressure refrigerant gas from main condenser 25 is returned to evaporator 27 as a mist. Alternatively, this refrigerant may be returned to compressor inlet 34.

In still another variation of this embodiment, as depicted in FIG. 13, two vessels may be located below auxiliary condenser 709, each having an inlet connected to the liquid outlet from auxiliary condenser 709 to receive condensed refrigerant liquid via conduit 730, a high pressure gas inlet 723 connected to receive high pressure gas, from main condenser 25 as shown in FIG. 13, and each having outlet 725 connected to evaporator 27. Condenser 25 is a convenient source for the high pressure gas in FIG. 13, but any other high pressure gas source may be utilized. High pressure gas inlet 723 provides the power to empty the fluid storage vessels or spaces 717, forcing the liquid from the fluid storage vessels 717 into the evaporator. The valves, depicted as valves 17, 18 and 19 in FIG. 13, are actuated to perform the function of alternatively emptying and filling each fluid storage vessel 717. Their operation is straightforward to those skilled in the art, having been used in some ice skating rinks to replace the liquid pump with the two receivers used alternatively: one being filled with the liquid draining from the auxiliary condenser, while the other is emptied by high pressure gas from the condenser. Each of these connections has an automatic valve that can be opened or closed. The system is operated in "batches", being activated by a control circuit using principles known to those skilled in the art. Liquid pump 719 is not required in this arrangement.

FIG. 15 is an alternative arrangement to that shown in FIG. 14. Both FIGS. 14 and 15 illustrate a pressure reducing device which is an auxiliary compressor. FIG. 15 provides another mode of active control for motor cooling by controlling the refrigerant introduced into motor 350 in order to avoid the intake of refrigerant liquid into auxiliary compressor 509. In FIG. 14, expansion valve 802 controls the flow of refrigerant into and from the coil that surrounds stator 88. Liquid refrigerant is introduced from condenser 25 (or subcooler if utilized) into the coil(s) that surrounds stator 88 through expansion valve 802 situated in line or conduit 378, see FIG. 8. Expansion valve 802 is controlled by a level sensor 805 that monitors the height of the liquid fluid column in secondary cavity 380. Refrigerant flowing through expansion valve 802 expands while having its pressure lowered. On entering secondary cavity 380, the liquid from the two-phase flow will fall by gravity to the bottom of secondary cavity 380. The amount of liquid refrigerant in secondary cavity 380 is determined by sensor 805 that detects fluid height in secondary cavity 380. Once the liquid height achieves a preselected level as determined by sensor 805, expansion valve 802 may be activated to reduce the flow of refrigerant fluid into secondary cavity. No liquid line is required between secondary cavity 380 and pressure reducing device 409. Only refrigerant gas will flow between rotor 129 and stator 88 and through line 392 to device 409. The increase of liquid refrigerant height as detected by sensor 805 in secondary cavity 380 indicates that no more refrigerant liquid should be sent into the motor, and expansion valve 802 will reduce the flow of refrigerant from stator 88. When the liquid refrigerant height in secondary cavity 380 has fallen below a preselected level as detected by sensor 805, a signal may be transmitted to expansion valve 802 to open and resume feeding refrigerant through conduit 378 to secondary cavity 380.

In FIGS. 14 and 15, device 409 may be any of the aforementioned devices. Thus it may be an auxiliary compressor 509 as set forth in FIG. 5, ejector pump 609 as set forth in FIG. 6, auxiliary condenser as set forth in FIG. 7 or any combination thereof, such as a compressor/condenser system of a condenser/pumping system.

Any of the embodiments allow for refrigerant to be used to cool the motor while removing refrigerant from the cavity of the motor, and the embodiments are not limited to a centrifugal compressor, which is exemplary in the Figures. Thus, the present invention may also find use with reciprocating compressors and scroll compressors, each of which requires motor cooling, and particularly when such compressors are adapted for use in heat pump systems. The system also provides cooling for bearings, particularly in systems utilizing magnetic bearings. The use of an auxiliary compressor 509 or ejector pump 609 may advantageously be used to remove refrigerant from the motor cavity. However, these components may require significant power consumption or otherwise penalize system efficiency. An auxiliary condenser 709 has the further advantage of not requiring power to operate, assuming that water at the desired temperature is available for heat exchange. But a system utilizing the auxiliary condenser also requires a liquid pump 719 to transfer condensed liquid to refrigerant system 21 at or near evaporating pressure. Although this does require a small amount of power, it is significantly less than the power required from operation of an auxiliary compressor 509, and there is no penalty to overall system efficiency when the liquid pump is replaced, such as with an ejector pump 609.

The basic pressure reducing devices described above with reference to FIGS. 10-13 effectively remove refrigerant from the cavity of the motor while allowing the refrigerant to remove heat from motor operation as well as magnetic bearings, when the system is so equipped. These pressure reducing devices can advantageously be utilized in heat pump applications systems which typically operate at higher temperatures than chiller systems. These pressure reducing devices extend the motor cooling capability of the refrigerant, permitting the use of chiller system equipment for heat pump applications and enable refrigerant to be circulated through the motor housing.

The description of the present invention provided above is with respect to a circuit having a compressor, such as a heat pump system or refrigeration system, where the condenser is on the higher pressure side of the refrigeration circuit and the evaporator is on the lower pressure side of the refrigeration circuit providing cooling to a motor, separation of refrigeration from lubricant or both. It will be understood that the present invention operates identically to an ORC system, which operates in reverse to the heat pump system as previously described, but where the evaporator is on the high pressure side of the circuit and the condenser is on the low pressure side of the circuit. The present invention serves to provide cooling to a generator, separation of refrigeration from lubricant or both.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A system for cooling a semi-hermetic compressor motor in a refrigeration or heat pump system using a refrigerant, the system including a refrigeration circuit comprising:

a compressor configured to raise a pressure of a refrigerant gas, a main condenser in fluid communication with the compressor and configured to condense the refrigerant gas into a high pressure liquid, an expansion valve in fluid communication with the condenser, the expansion valve configured to convert the high pressure liquid into a mist of liquid entrained in gas, an evaporator in communication with the expansion valve and with the compressor, the evaporator configured to change a state of liquid refrigerant to refrigerant gas, the compressor further including a compressor motor, the compressor motor further including shaft, a housing for the motor, the housing having a cavity, the motor housed in the housing, the motor having a stator configured to alternate an electric field, and a rotor attached to the shaft, the rotor and the shaft configured to rotate with the alternating electrical field;

a refrigerant inlet in the housing;

a refrigerant outlet from the housing; and a refrigerant pressure reducing device in communication with the housing and with a low pressure region of the system that is downstream of the expansion valve and upstream of a compressor inlet, wherein the refrigerant pressure reducing device is configured to draw refrigerant from the housing, reduce refrigerant pressure to a pressure lower than that of the low pressure region of the system, and direct refrigerant toward the low pressure region of the system.

2. The system of claim 1, comprising a magnetic bearing system configured to the shaft when the system is operational.

3. The system of claim 1, wherein the refrigerant pressure reducing device is an auxiliary compressor.

4. The system of claim 1, wherein the refrigerant pressure reducing device is an ejector pump.

5. The system of claim 1, wherein the refrigerant pressure reducing device comprises a circuit in communication with the housing and the low pressure region of the system, the circuit comprising an auxiliary condenser configured to cool and condense refrigerant gas from the housing, a conduit extending between the housing and the auxiliary condenser to transport refrigerant to the auxiliary condenser, a fluid storage space in fluid communication with the auxiliary condenser, the fluid storage space configured to store condensed refrigerant after cooling in the auxiliary condenser, a liquid pump configured to pump refrigerant from the fluid storage space to the low pressure region of the system, and a liquid level sensor configured to an amount of liquid in the fluid storage space.

6. The system of claim 1, wherein the refrigerant pressure reducing device comprises a circuit in communication with the housing and the low pressure region of the system, the circuit comprising an auxiliary condenser configured to cool and condense refrigerant gas, a conduit extending between the housing and the auxiliary condenser to transport refrigerant gas from the housing to the auxiliary condenser, a fluid storage space in fluid communication with the auxiliary condenser, the fluid storage space configured to store condensed refrigerant after cooling in the auxiliary condenser, and a valve configured to regulate refrigerant flow from the fluid storage space to the low pressure region of the system.

* * * * *